US012590350B2

(12) United States Patent
Kawasaki et al.

(10) Patent No.: US 12,590,350 B2
(45) Date of Patent: Mar. 31, 2026

(54) STEEL SHEET, MEMBER, AND METHOD FOR PRODUCING THEM

(71) Applicant: JFE STEEL CORPORATION, Tokyo (JP)

(72) Inventors: Yoshiyasu Kawasaki, Tokyo (JP); Tatsuya Nakagaito, Tokyo (JP); Shunsuke Yamamoto, Tokyo (JP); Katsuya Hoshino, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 53 days.

(21) Appl. No.: 18/847,395

(22) PCT Filed: Nov. 30, 2022

(86) PCT No.: PCT/JP2022/044175
§ 371 (c)(1),
(2) Date: Sep. 16, 2024

(87) PCT Pub. No.: WO2023/188539
PCT Pub. Date: Oct. 5, 2023

(65) Prior Publication Data

US 2025/0197961 A1 Jun. 19, 2025

(30) Foreign Application Priority Data

Mar. 31, 2022 (JP) ..... 2022-059631

(51) Int. Cl.

| | |
|---|---|
| ***C21D 6/00*** | (2006.01) |
| ***C21D 8/02*** | (2006.01) |
| ***C21D 8/0221*** | (2026.01) |
| ***C21D 8/0247*** | (2026.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C22C 38/16*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |
| ***C22C 38/58*** | (2006.01) |
| ***C22C 38/60*** | (2006.01) |

(52) U.S. Cl.

CPC ..... *C21D 9/46* (2013.01); *C21D 6/005* (2013.01); *C21D 6/008* (2013.01); *C21D 8/02* (2013.01); *C21D 8/0226* (2013.01); *C21D 8/0236* (2013.01); *C21D 8/0263* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/12* (2013.01); *C22C 38/14* (2013.01); *C22C 38/16* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C22C 38/58* (2013.01); *C22C 38/60* (2013.01)

(58) Field of Classification Search

CPC ..... C22C 38/02; C22C 38/04; C22C 38/06; C21D 6/005; C21D 6/008; C21D 8/0263

See application file for complete search history.

(56) References Cited

U.S. PATENT DOCUMENTS

| | | | |
|---|---|---|---|
| 10,450,642 | B2 | 10/2019 | Hasegawa et al. |
| 2012/0152411 | A1 | 6/2012 | Morimoto et al. |
| 2019/0112681 | A1 | 4/2019 | Nakagaito et al. |
| 2021/0062288 | A1 | 3/2021 | Nishio et al. |
| 2022/0195552 | A1 | 6/2022 | Minami et al. |

FOREIGN PATENT DOCUMENTS

| | | | |
|---|---|---|---|
| EP | 4 130 323 | A1 | 2/2023 |
| EP | 4 130 324 | A1 | 2/2023 |
| EP | 4 130 325 | A1 | 2/2023 |
| JP | 3887235 | B2 | 12/2006 |
| JP | 5699764 | B2 | 2/2015 |

(Continued)

OTHER PUBLICATIONS

English translation of JP2017002384A obtained from EPO espacenet Jan. 7, 2026. (Year: 2026).*

Extended European Search Report issued May 14, 2025, by the European Patent Office in corresponding European Patent Application No. 22935668.8-1103. (11 pages).

(Continued)

*Primary Examiner* — Adam Krupicka

(74) *Attorney, Agent, or Firm* — Buchanan Ingersoll & Rooney PC

(57) ABSTRACT

A steel sheet and a member with a TS of 590 MPa or more and a method for producing them are disclosed. A base steel sheet has a specified chemical composition. When nanohardness is measured at 300 points or more in a 50 μm×50 μm region on a sheet surface at a quarter depth position, the ratio of a nanohardness of 7.0 GPa or more is 0.10 or less, the nanohardness of the sheet surface at the quarter depth position has a standard deviation σ of 1.8 GPa or less, and the nanohardness of the sheet surface at a half depth position has a standard deviation σ of 2.2 GPa or less.

16 Claims, 4 Drawing Sheets

(56) References Cited

FOREIGN PATENT DOCUMENTS

| | | | |
|---|---|---|---|
| JP | 5953693 | B2 | 6/2016 |
| JP | 6052472 | B2 | 12/2016 |
| JP | 2017002384 | A | 1/2017 |
| WO | 2011025042 | A1 | 3/2011 |
| WO | 2017168957 | A1 | 10/2017 |
| WO | 2019181950 | A1 | 9/2019 |
| WO | 2020184154 | A1 | 9/2020 |
| WO | 2021/200578 | A1 | 10/2021 |
| WO | 2021/200579 | A1 | 10/2021 |
| WO | 2021/200580 | A1 | 10/2021 |

OTHER PUBLICATIONS

International Search Report (PCT/ISA/210) with translation and Written Opinion (PCT/ISA/237) mailed on Feb. 21, 2023, by the Japanese Patent Office as the International Searching Authority for International Application No. PCT/JP2022/044175. (8 pages).

* cited by examiner (a)

(b)

STEEL SHEET, MEMBER, AND METHOD FOR PRODUCING THEM

CROSS REFERENCE TO RELATED APPLICATIONS

This is the U.S. National Phase application of PCT/JP2022/044175, filed Nov. 30, 2022, which claims priority to Japanese Patent Application No. 2022-059631, filed Mar. 31, 2022, the disclosures of these applications being incorporated herein by reference in their entireties for all purposes.

FIELD OF THE INVENTION

The present invention relates to a steel sheet, a member made of the steel sheet, and methods for producing them.

BACKGROUND OF THE INVENTION

Automotive steel sheets have been strengthened to achieve both the reduction of $CO_2$ emissions due to an improvement of fuel efficiency by reducing the thickness and weight of steel sheets used in automobile bodies and an improvement of crash safety. Furthermore, new laws and regulations are continuously introduced. Thus, for the purpose of increasing the strength of an automobile body, high-strength steel sheets are increasingly applied to main structural members and reinforcing members (hereinafter also referred to as automobile frame structural members or the like) to be assembled to frames of automobile cabins. Furthermore, high-strength steel sheets used for frame structural members or the like of automobiles are required to have high member strength after press forming. To increase the strength of a component, for example, it is effective to increase the yield stress (hereinafter also referred to simply as YS) of a steel sheet. This increases the impact absorbed energy in case of a vehicle collision (hereinafter also referred to simply as impact absorbed energy). Furthermore, among frame structural members and the like of automobiles, for example, crash boxes and the like have bent portions. From the perspective of press formability, therefore, a steel sheet with high bendability is preferably applied to such a component. Furthermore, from the perspective of anti-rust performance of an automobile body, a steel sheet serving as a material of an automobile body component is often galvanized. Thus, the development of a hot-dip galvanized steel sheet with high press formability and good anti-crash property in addition to high strength has been desired.

For example, Patent Literature 1 discloses, as such a steel sheet serving as a material of an automobile body component, a high-strength steel sheet with high stretch-flangeability and good anti-crash property, which has a chemical composition containing, on a mass percent basis, C: 0.04% to 0.22%, Si: 1.0% or less, Mn: 3.0% or less, P: 0.05% or less, S: 0.01% or less, Al: 0.01% to 0.1%, and N: 0.001% to 0.005%, the remainder being Fe and incidental impurities, and which is composed of a ferrite phase as a main phase and a martensite phase as a second phase, the martensite phase having a maximum particle size of 2 μm or less and an area fraction of 5% or more.

Patent Literature 2 discloses a high-strength hot-dip galvanized steel sheet with high coating adhesion and formability having a hot-dip galvanized layer on the surface of a cold-rolled steel sheet, which has a surface layer ground off with a thickness of 0.1 μm or more and is pre-coated with 0.2 $g/m^2$ or more and 2.0 $g/m^2$ or less of Ni, wherein the hot-dip galvanized steel sheet contains, on a mass percent basis, C: 0.05% or more and 0.4% or less, Si: 0.01% or more and 3.0% or less, Mn: 0.1% or more and 3.0% or less, P: 0.04% or less, S: 0.05% or less, N: 0.01% or less, Al: 0.01% or more and 2.0% or less, Si+Al>0.5%, the remainder being Fe and incidental impurities, has a microstructure having a hot-dip galvanized layer containing less than 7% Fe and the remainder composed of Zn, Al, and incidental impurities, on the surface of a steel sheet containing, on a volume fraction basis, 40% or more ferrite as a main phase, 8% or more retained austenite, two or more of three types of martensite [1], [2], and [3] as specified below including martensite [3], 1% or more bainite, and 0% to 10% pearlite, the three types of martensite [1], [2], and [3] being, on a volume fraction basis, martensite [1]: 0% or more and 50% or less, martensite [2]: 0% or more and less than 20%, and martensite [3]: 1% or more and 30% or less, and has TS×EL of 18000 MPa·% or more and TS×λ of 35000 MPa·% or more, wherein TS denotes tensile strength (MPa), EL denotes total elongation percentage (%), and A denotes hole expansion ratio (%), and a tensile strength of 980 MPa or more (when martensite [1]:C concentration (CM1) is less than 0.8%, hardness Hv1 satisfies $Hv1/(-982.1\times CM1^2+1676\times CM1+189)\leq 0.60$, when martensite [2]:C concentration (CM2) is 0.8% or more, the hardness Hv2 satisfies $Hv2/(-982.1\times CM2^2+1676\times CM2+189)\leq 0.60$, and when martensite [3]:C concentration (CM3) is 0.8% or more, the hardness Hv3 satisfies $Hv3/(-982.1\times CM3^2+1676\times CM3+189)\geq 0.80$).

Patent Literature 3 discloses a high-strength hot-dip galvanized steel sheet that has a chemical composition composed of, on a mass percent basis, C: 0.15% or more and 0.25% or less, Si: 0.50% or more and 2.5% or less, Mn: 2.3% or more and 4.0% or less, P: 0.100% or less, S: 0.02% or less, and Al: 0.01% or more and 2.5% or less, the remainder being Fe and incidental impurities, and that has a steel sheet microstructure having, on an area fraction, a tempered martensite phase: 30% or more and 73% or less, a ferrite phase: 25% or more and 68% or less, a retained austenite phase: 2% or more and 20% or less, and another phase: 10% or less (including 0%), the other phase being a martensite phase: 3% or less (including 0%) and bainitic ferrite phase: less than 5% (including 0%), the tempered martensite phase having an average grain size of 8 μm or less, the retained austenite phase having a C content of less than 0.7% by mass.

Patent Literature 4 discloses a hot-dip galvannealed steel sheet having a hot-dip galvannealed layer on the surface of the steel sheet, wherein the steel sheet has a chemical composition of, on a mass percent basis, C: 0.03% or more and 0.35% or less, Si: 0.005% or more and 2.0% or less, Mn: 1.0% or more and 4.0% or less, P: 0.0004% or more and 0.1% or less, S: 0.02% or less, sol·Al: 0.0002% or more and 2.0% or less, and N: 0.01% or less, the remainder being Fe and impurities, the concentrated portion average interval is 1000 μm or less at a depth of 50 μm from the surface of the steel sheet, the concentrated portion average interval being an average interval in the direction perpendicular to the rolling direction of a concentrated portion in which Mn and/or Si expanded in the rolling direction is concentrated, the number density of cracks at a depth of 3 μm or more and 10 μm or less on the surface of the steel sheet is 3/mm or more and 1000/mm or less, the steel sheet has a steel microstructure containing, on an area percent basis, bainite: 60% or more, retained austenite: 1% or more, martensite: 1% or more, and ferrite: 2% or more and less than 20%, and having a superhard phase average interval, which is the average closest distance of martensite and retained austenite, of 20 μm or less, and the hot-dip galvannealed steel sheet has mechanical characteristics with a tensile strength (TS) of 780 MPa or more.

PATENT LITERATURE

PTL 1: Japanese Patent No. 3887235
PTL 2: Japanese Patent No. 5953693
PTL 3: Japanese Patent No. 6052472
PTL 4: Japanese Patent No. 5699764

SUMMARY OF THE INVENTION

Incidentally, although a steel sheet with a tensile strength TS (hereinafter also referred to simply as TS) of more than 590 MPa has been applied to a structural member of an automobile exemplified by a center pillar, only a steel sheet with a TS of 590 MPa grade is applied to an impact energy absorbing member of an automobile exemplified by a front side member or a rear side member.

Thus, to increase absorbed energy in case of a collision (hereinafter also referred to as impact absorbed energy), it is effective to improve yield stress YS (hereinafter also referred to simply as YS). However, a steel sheet with higher YS typically has lower press formability and, in particular, lower ductility, flangeability, bendability, and the like. Thus, when such a steel sheet with higher TS and YS is applied to the impact energy absorbing member of an automobile, not only press forming is difficult, but also the member cracks in an axial compression test simulating a collision test. In other words, the actual impact absorbed energy is not increased as expected from the value of YS. Thus, the related art has room for improvement.

Actually, it cannot be said that the steel sheets disclosed in Patent Literature 1 to Patent Literature 4 also have high YS and YR, high press formability (ductility, flangeability, and bendability), and fracture resistance characteristics (bending fracture characteristics and axial crushing characteristics) in case of a collision.

Aspects of the present invention have been developed in view of such circumstances and aim to provide a steel sheet with a tensile strength TS of 590 MPa or more, high yield stress YS, high press formability (ductility, flangeability, and bendability), and fracture resistance characteristics (bending fracture characteristics and axial crushing characteristics) in case of a collision, and a method for producing the steel sheet. Aspects of the present invention also aim to provide a member made of the steel sheet and a method for producing the member.

The tensile strength TS is measured in a tensile test according to JIS Z 2241.

High yield stress YS means that the yield stress (YS) measured in the tensile test according to JIS Z 2241 satisfies the following formulae (A) to (F) depending on TS measured in the tensile test.

(A) For 590 MPa≤TS<780 MPa, 350 MPa≤YS
(B) For 780 MPa≤TS<980 MPa, 400 MPa≤YS
(C) For 980 MPa≤TS<1180 MPa, 550 MPa≤YS
(D) For 1180 MPa≤TS<1320 MPa, 750 MPa≤YS
(E) For 1320 MPa≤TS<1470 MPa, 900 MPa≤YS
(F) For 1470 MPa≤TS, 1050 MPa≤YS

High ductility means that the total elongation (El) measured in the tensile test according to JIS Z 2241 satisfies the following formulae (A) to (F) depending on TS measured in the tensile test.

(A) For 590 MPa≤TS<780 MPa, 24.0%≤El
(B) For 780 MPa≤TS<980 MPa, 18.0%≤El
(C) For 980 MPa≤TS<1180 MPa, 11.0%≤El
(D) For 1180 MPa≤TS<1320 MPa, 8.0%≤El
(E) For 1320 MPa≤TS<1470 MPa, 7.5%≤El
(F) For 1470 MPa≤TS, 7.0%≤El

High flangeability means a limiting hole expansion ratio (λ) of 20% or more as measured in a hole expansion test according to JIS Z 2256.

High bendability means that R (critical bending radius)/t (thickness) measured in a V-bending test according to JIS Z 2248 satisfies the following formulae (A) to (F) depending on TS.

(A) For 590 MPa≤TS<780 MPa, 1.0≥R/t
(B) For 780 MPa≤TS<980 MPa, 2.0≥R/t
(C) For 980 MPa≤TS<1180 MPa, 2.5≥R/t
(D) For 1180 MPa≤TS<1320 MPa, 3.0≥R/t
(E) For 1320 MPa≤TS<1470 MPa, 3.5≥R/t
(F) For 1470 MPa≤TS, 4.0≥R/t

Good bending fracture characteristics mean that the stroke at the maximum load (SFmax) measured in a V-bending+orthogonal VDA bending test satisfies the following formulae (A) to (F) depending on TS.

(A) For 590 MPa≤TS<780 MPa, 29.0 mm≤SFmax
(B) For 780 MPa≤TS<980 MPa, 27.5 mm≤SFmax
(C) For 980 MPa≤TS<1180 MPa, 27.0 mm≤SFmax
(D) For 1180 MPa≤TS<1320 MPa, 26.0 mm≤SFmax
(E) For 1320 MPa≤TS<1470 MPa, 24.5 mm≤SFmax
(F) For 1470 MPa≤TS, 24.0 mm≤SFmax Good axial crushing characteristics mean that a sample after an axial crushing test in the axial crushing test has no fracture (appearance crack) or that a sample after the axial crushing test has only one appearance crack.

The El (ductility), λ (stretch-flangeability), and R/t (bendability) are characteristics indicating the ease of forming a steel sheet during press forming (the degree of freedom of forming for press forming without cracking). On the other hand, the V-bending+orthogonal VDA bending test is a test simulating the deformation and fracture behavior of a bending ridge line portion in a collision test, and the stroke at the maximum load (SFmax) measured in the V-bending+orthogonal VDA bending test is a measure indicating the resistance to cracking of an energy absorbing member.

As a result of extensive studies to achieve the objects, the present inventors have found the following.

It has been found that it is possible under the following conditions to improve a measure of bendability R/t, which is one mode of press formability, and the stroke at the maximum load (SFmax) measured in a V-bending+orthogonal VDA bending test that simulates the deformation and fracture behavior of a bending ridge line portion in a collision test, which is a measure of the anti-crash property of a steel sheet and a member of an automobile body in case of a collision. The conditions include a specified component and are that the ratio of a nanohardness of 7.0 GPa or more is 0.10 or less when the nanohardness is measured at 300 points or more in a 50 μm×50 μm region on a sheet surface at a quarter depth position in the thickness direction of a surface soft layer from the surface of the steel sheet (the surface of a base (underlying) steel sheet), the nanohardness of the sheet surface at the quarter depth position in the thickness direction of the surface soft layer from the surface of the base steel sheet has a standard deviation σ of 1.8 GPa or less, and the nanohardness of the sheet surface at a half depth position in the thickness direction of the surface soft layer has a standard deviation σ of 2.2 GPa or less when the nanohardness of the sheet surface at the half depth position in the thickness direction of the surface soft layer from the surface of the base steel sheet is measured in the same manner as that at the quarter position.

The present disclosure is based on these findings. The gist of the present disclosure is as follows:

[1]A steel sheet including a base steel sheet with a chemical composition containing, on a mass percent basis, C: 0.030% or more and 0.500% or less, Si: 0.01% or more and 3.00% or less, Mn: 0.30% or more and less than 10.00%, P: 0.001% or more and 0.100% or less, S: 0.0200% or less, Al: 0.005% or more and 2.000% or less, and N: 0.0100% or less, wherein Ceq represented by the following formula (1) satisfies 0.30% or more and 0.85% or less, the remainder being Fe and incidental impurities, a surface soft layer with a Vickers hardness of 85% or less with respect to a Vickers hardness at a quarter thickness position of the base steel sheet is formed in a region of 200 μm or less from a surface of the base steel sheet in a thickness direction, when nanohardness is measured at 300 points or more in a 50 μm×50 μm region on a sheet surface at a quarter depth position in the thickness direction and at a half depth position in the thickness direction of the surface soft layer from the surface of the base steel sheet, a ratio of a number of measurements with a nanohardness of 7.0 GPa or more on the sheet surface at the quarter depth position in the thickness direction of the surface soft layer from the surface of the base steel sheet to a total number of measurements is 0.10 or less, the nanohardness of the sheet surface at the quarter depth position in the thickness direction of the surface soft layer from the surface of the base steel sheet has a standard deviation σ of 1.8 GPa or less, and the nanohardness of the sheet surface at the half depth position in the thickness direction of the surface soft layer from the surface of the base steel sheet has a standard deviation σ of 2.2 GPa or less, $$Ceq = [\%\ C] + [\%\ Mn]/6 + [\%\ Si]/24 + [\%\ Ni]/40 + [\%\ Cr]/5 + [\%\ Mo]/4 + [\%\ V]/14 \quad \text{formula (1)}$$

wherein [% C] denotes a C content, [% Mn] denotes a Mn content, [% Si] denotes a Si content, [% Ni] denotes a Ni content, [% Cr] denotes a Cr content, [% Mo] denotes a Mo content, and [% V] denotes a V content, and these are 0 (zero) when not contained.

[2] The steel sheet according to [1], wherein ferrite and bainite present in the surface soft layer have a total area fraction of 20% or more, and an area fraction of martensite present in the surface soft layer divided by a total area fraction of martensite and tempered martensite present in the surface soft layer is 0.45 or less.

[3] The steel sheet according to [1] or [2], wherein the chemical composition further contains, on a mass percent basis, at least one element selected from Nb: 0.200% or less, Ti: 0.200% or less, V: 0.200% or less, B: 0.0100% or less, Cr: 1.000% or less, Ni: 1.000% or less, Mo: 1.000% or less, Sb: 0.200% or less, Sn: 0.200% or less, Cu: 1.000% or less, Ta: 0.100% or less, W: 0.500% or less, Mg: 0.0200% or less, Zn: 0.0200% or less, Co: 0.0200% or less, Zr: 0.1000% or less, Ca: 0.0200% or less, Se: 0.0200% or less, Te: 0.0200% or less, Ge: 0.0200% or less, As: 0.0500% or less, Sr: 0.0200% or less, Cs: 0.0200% or less, Hf: 0.0200% or less, Pb: 0.0200% or less, Bi: 0.0200% or less, and REM: 0.0200% or less.

[4] The steel sheet according to any one of [1] to [3], including a metal coated layer as a first coated layer on one or both surfaces of the base steel sheet.

[5] The steel sheet according to any one of [1] to [4], including a metal coated layer as a second coated layer on an outermost surface layer of one or both surfaces of the steel sheet.

[6] The steel sheet according to any one of [1] to [5], wherein a test specimen after 90-degree V-bending in which R/t obtained by dividing a critical bending radius R by a sheet thickness t is 4.5 or more and 5.0 or less has a surface roughness depth of 20.0 μm or less.

[7]A member including the steel sheet according to any one of [1] to [6].

[8]A method for producing a steel sheet, including:

a hot rolling step of hot-rolling a steel slab with the chemical composition according to [1] or [3];

an annealing step of annealing the resulting steel sheet in an atmosphere with an annealing temperature of an $Ac_1$ point or more and 950° C. or less, an annealing time of 10 seconds or more, and a dew-point temperature of −30° C. or more;

a first cooling step of cooling the steel sheet after the annealing step in a temperature range of the $Ac_1$ point to 450° C., in an atmosphere with a dew-point temperature of −30° C. or less, and at an average cooling rate of 8° C./s or more; and a second cooling step of cooling the steel sheet after the first cooling step at an average cooling rate of less than 8° C./s in a temperature range of less than 450° C. to 300° C.

[9] The method for producing a steel sheet according to [8], including a cold rolling step of cold-rolling the steel sheet after the hot rolling step and before the annealing step.

[10] The method for producing a steel sheet according to [8] or [9], including a first coating step of performing metal coating on one or both surfaces of the steel sheet after the hot rolling step and before the annealing step to form a first coated layer.

[11] The method for producing a steel sheet according to any one of [8] to [10], including a second coating step of performing coating treatment on the steel sheet after the second cooling step.

[12] The method for producing a steel sheet according to any one of [8] to [11], including, after the second cooling step, a reheating and holding step of cooling the steel sheet to a cooling stop temperature in the range of 250° C. to room temperature, reheating the steel sheet to a reheating temperature range of (the cooling stop temperature+50° C.) to 450° C., and holding the steel sheet in the reheating temperature range for 10 seconds or more.

[13] A method for producing a member, including a step of subjecting the steel sheet according to any one of [1] to [6] to at least one of forming and joining to produce a member.

Aspects of the present invention provide a steel sheet with a tensile strength TS of 590 MPa or more, high yield stress YS, high press formability (ductility, flangeability, and bendability), and fracture resistance characteristics (axial crushing characteristics) in case of a collision.

Furthermore, a member including a steel sheet according to aspects of the present invention as a material has high strength, high press formability, and good anti-crash property, and can therefore be extremely advantageously applied to a structural member, an impact energy absorbing member, and the like of an automobile.

BRIEF DESCRIPTION OF THE DRAWINGS

FIG. 2(*b*) is an explanatory view of orthogonal VDA bending (secondary bending) in a V-bending+orthogonal VDA bending test in Examples.

FIG. 3-1(*a*) is a front view of a test member composed of a hat-shaped member and a steel sheet spot-welded together for an axial crushing test in Examples. FIG. 3-1(*b*) is a perspective view of the test member illustrated in (a).

FIG. 3-2(*c*) is a schematic explanatory view of an axial crushing test in Examples.

DETAILED DESCRIPTION OF EMBODIMENTS OF THE INVENTION

Figure 1:
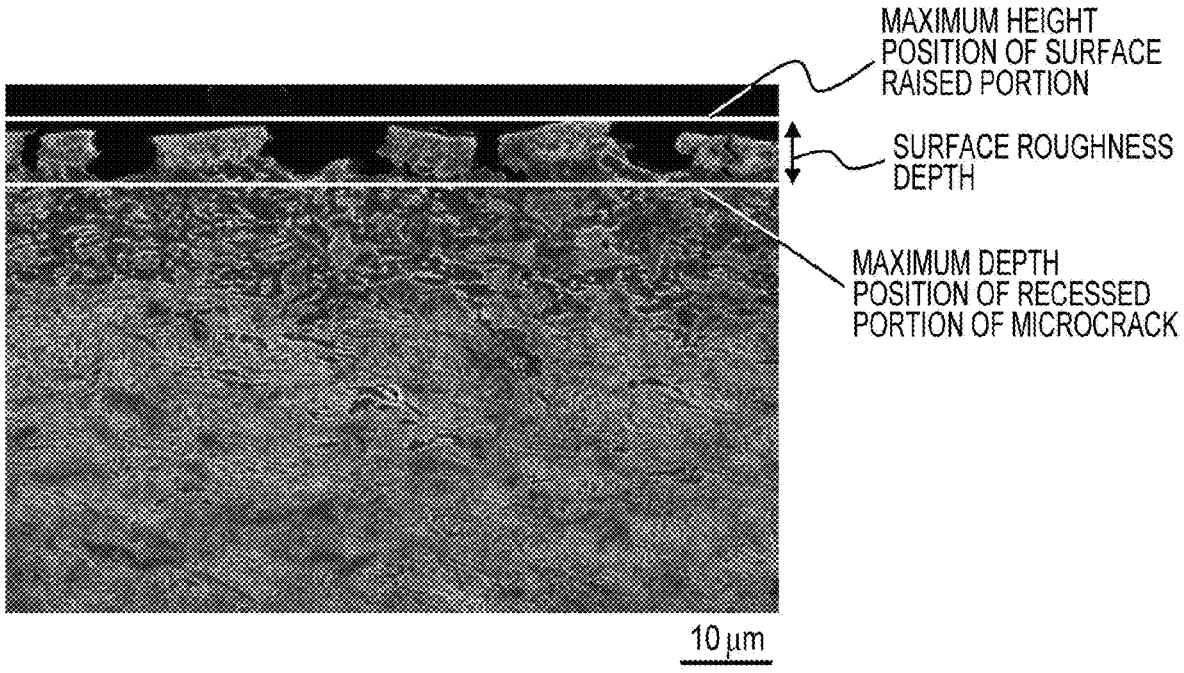
FIG. 1 is a cross-sectional picture for explaining the surface roughness depth.

Aspects of the present invention are described on the basis of the following embodiments.

[1. Steel Sheet]

A steel sheet according to aspects of the present invention includes a base steel sheet with a chemical composition containing, on a mass percent basis, C: 0.030% or more and 0.500% or less, Si: 0.01% or more and 3.00% or less, Mn: 0.30% or more and less than 10.00%, P: 0.001% or more and 0.100% or less, S: 0.0200% or less, Al: 0.005% or more and 2.000% or less, and N: 0.0100% or less, wherein Ceq represented by the following formula (1) satisfies 0.30% or more and 0.85% or less, the remainder being Fe and incidental impurities, a surface soft layer with a Vickers hardness of 85% or less with respect to a Vickers hardness at a quarter thickness position is formed in a region of 200 μm or less from a surface of the base steel sheet in a thickness direction, when nanohardness is measured at 300 points or more in a 50 μm×50 μm region on a sheet surface at a quarter depth position in the thickness direction and at a half depth position in the thickness direction of the surface soft layer from the surface of the base steel sheet, a ratio of a number of measurements with a nanohardness of 7.0 GPa or more on the sheet surface at the quarter depth position in the thickness direction of the surface soft layer from the surface of the base steel sheet to a total number of measurements is 0.10 or less, the nanohardness of the sheet surface at the quarter depth position in the thickness direction of the surface soft layer from the surface of the base steel sheet has a standard deviation σ of 1.8 GPa or less, and the nanohardness of the sheet surface at the half depth position in the thickness direction of the surface soft layer from the surface of the base steel sheet has a standard deviation σ of 2.2 GPa or less, $$Ceq = [\%\ C] + [\%\ Mn]/6 + [\%\ Si]/24 + [\%\ Ni]/40 + [\%\ Cr]/5 + [\%\ Mo]/4 + [\%\ V]/14 \quad \text{formula (1)}$$

wherein [% C] denotes a C content, [% Mn] denotes a Mn content, [% Si] denotes a Si content, [% Ni] denotes a Ni content, [% Cr] denotes a Cr content, [% Mo] denotes a Mo content, and [% V] denotes a V content, and these are 0 (zero) when not contained.

Chemical Composition

First, the chemical composition of a base steel sheet of a steel sheet according to an embodiment of the present invention is described. The unit in the chemical composition is "% by mass" and is hereinafter expressed simply in "%" unless otherwise specified.

In accordance with aspects of the present invention, a steel sheet has a base steel sheet, and a coated layer (a metal coated layer (a first coated layer) or a coated layer (a second coated layer), for example, a galvanized layer, such as a hot-dip galvanized layer, a hot-dip galvannealed layer, or an electrogalvanized layer, or a hot-dip aluminum coated layer) on the base steel sheet is described later. This coated layer is a suitable component of a steel sheet, and a steel sheet does not necessarily have the coated layer.

C: 0.030% or More and 0.500% or Less

C is an element effective in forming an appropriate amount of tempered martensite, bainite, or the like to ensure high TS and YS. A C content of less than 0.030% results in an increased area fraction of ferrite and makes it difficult to have desired TS. This also results in a reduced YS. On the other hand, a C content of more than 0.500% results in an increased area fraction of martensite, excessively high TS, and undesired El (press formability (ductility)) and R/t (press formability (bendability)). This also results in an increased volume fraction (area fraction) of retained austenite, the formation of hard martensite by deformation-induced transformation of retained austenite when a steel sheet is punched in a hole expansion test or is subjected to V-bending in a V-bending+orthogonal VDA test, the formation of a void and the propagation of a crack in a subsequent test, and undesired A (press formability (flangeability)) and SFmax (fracture resistance characteristics (bending fracture characteristics) in case of a collision). Thus, the C content is 0.030% or more and 0.500% or less. The C content is preferably 0.050% or more. The C content is preferably 0.300% or less.

Si: 0.01% or More and 3.00% or Less

Si promotes ferrite transformation during annealing and in a cooling process after annealing. Thus, Si is an element that affects the area fraction of ferrite. A Si content of less than 0.01% results in a decreased area fraction of ferrite and lower ductility. A Si content of more than 3.00% results in an increased volume fraction of retained austenite, the formation of hard martensite by deformation-induced transformation of retained austenite when a steel sheet is punched in a hole expansion test and is subjected to V-bending in a V-bending+orthogonal VDA test, the formation of a void and the propagation of a crack in a subsequent test, and undesired desired λ and SFmax. Thus, the Si content is 0.01% or more and 3.00% or less. The Si content is preferably 0.10% or more. The Si content is preferably 2.0% or less.

Mn: 0.30% or More and Less than 10.00%

Mn is an element that adjusts the area fraction of tempered martensite, bainite, or the like. A Mn content of less than 0.30% results in an increased area fraction of ferrite and makes it difficult to have desired TS. This also reduces YS. On the other hand, a Mn content of 10.00% or more results in the formation and increase of ε-martensite, which is a brittle phase, and undesired El (press formability (ductility)), R/t (press formability (bendability)), and SFmax (fracture resistance characteristics (bending fracture characteristics) in case of a collision). Thus, the Mn content is 0.30% or more and less than 10.00%. The Mn content is preferably 1.00% or more. The Mn content is preferably 3.50% or less.

P: 0.001% or More and 0.100% or Less

P is an element that has a solid-solution strengthening effect and increases the TS and YS of a steel sheet. To produce such effects, the P content is 0.001% or more. On the other hand, a P content of more than 0.100% results in segregation of P at a prior-austenite grain boundary and embrittlement of the grain boundary. This results in the formation of a void and the propagation of a crack along the prior-austenite grain boundary and undesired R/t in a V-bending test. Furthermore, when a steel sheet is punched in a hole expansion test or is subjected to V-bending in a V-bending+orthogonal VDA test, this results in the formation of a void and the propagation of a crack along the prior-austenite grain boundary and undesired A and SFmax. Thus, the P content is 0.001% or more and 0.100% or less. The P content is preferably 0.030% or less.

S: 0.0200% or Less

S is present as a sulfide in steel. In particular, a S content of more than 0.0200% results in the formation of a void and the propagation of a crack from the sulfide as a starting point in a V-bending test and undesired R/t. Furthermore, when a steel sheet is punched in a hole expansion test or is subjected to V-bending in a V-bending+orthogonal VDA test, this results in the formation of a void and the propagation of a crack from the sulfide as a starting point and undesired A and SFmax. Thus, the S content is 0.0200% or less. The S content is preferably 0.0080% or less. The S content may have any lower limit but is preferably 0.0001% or more due to constraints on production technology.

Al: 0.005% or More and 2.000% or Less

Al promotes ferrite transformation during annealing and in a cooling process after annealing. Thus, Al is an element that affects the area fraction of ferrite. An Al content of less than 0.005% results in a decreased area fraction of ferrite and lower ductility. On the other hand, an Al content of more than 2.000% results in an excessively increased area fraction of ferrite and makes it difficult to have desired TS. This also reduces YS. Thus, the Al content is 0.005% or more and 2.000% or less. The Al content is preferably 0.010% or more, more preferably 0.015% or more. The Al content is preferably 1.000% or less.

N: 0.0100% or Less

N is present as a nitride in steel. In particular, a N content of more than 0.0100% results in the formation of a void and the propagation of a crack from the nitride as a starting point in a V-bending test and undesired R/t. Furthermore, when a steel sheet is punched in a hole expansion test or is subjected to V-bending in a V-bending+orthogonal VDA test, this results in the formation of a void and the propagation of a crack from the nitride as a starting point and undesired A and SFmax. Thus, the N content is 0.0100% or less. The N content is preferably 0.0050% or less. The N content may have any lower limit but is preferably 0.0005% or more due to constraints on production technology.

Ceq: 0.30% or More and 0.85% or Less

Ceq is a measure for forming an appropriate amount of martensite, retained austenite, tempered martensite, or the like and ensuring high TS and YS. Ceq of less than 0.30% makes it difficult to form martensite, retained austenite, or tempered martensite at a quarter thickness position and to ensure desired TS and YS. On the other hand, Ceq of more than 0.85% results in an increased area fraction of martensite, excessively high TS, and undesired El (press formability (ductility)) and R/t (press formability (bendability)). This also results in an increased volume fraction of retained austenite, the formation of hard martensite by deformation-induced transformation of retained austenite when a steel sheet is punched in a hole expansion test and is subjected to V-bending in a V-bending+orthogonal VDA test, the formation of a void and the propagation of a crack in a subsequent test, and undesired A (press formability (flangeability)) and SFmax (fracture resistance characteristics (bending fracture characteristics) in case of a collision). Thus, Ceq is 0.30% or more and 0.85% or less. Ceq is preferably 0.35% or more. Ceq is preferably 0.80% or less. Ceq is calculated using the following formula (1):

$$Ceq = [\%\ C] + [\%\ Mn]/6 + [\%\ Si]/24 + [\%\ Ni]/40 + [\%\ Cr]/5 + [\%\ Mo]/4 + [\%\ V]/14 \quad \text{formula (1)}$$

wherein [% C] denotes a C content, [% Mn] denotes a Mn content, [% Si] denotes a Si content, [% Ni] denotes a Ni content, [% Cr] denotes a Cr content, [% Mo] denotes a Mo content, and [% V] denotes a V content, and these are 0 (zero) when not contained.

A base chemical composition of a base steel sheet of a steel sheet according to an embodiment of the present invention has been described above. A base steel sheet of a hot-dip galvanized steel sheet according to an embodiment of the present invention has a chemical composition that contains the base components and the remainder other than the base components including Fe (iron) and incidental impurities. A base steel sheet of a hot-dip galvanized steel sheet according to an embodiment of the present invention preferably has a chemical composition that contains the base components and the remainder composed of Fe and incidental impurities.

A base steel sheet of a steel sheet according to an embodiment of the present invention may contain, in addition to the base components, at least one selected from the following optional components. As long as the following optional components are contained in an amount equal to or less than their respective upper limits described below, the advantages according to aspects of the present invention can be achieved. Thus, there is no particular lower limit. Any of the following optional elements contained below appropriate lower limits described below is contained as an incidental impurity.

At least one selected from Nb: 0.200% or less, Ti: 0.200% or less, V: 0.200% or less, B: 0.0100% or less, Cr: 1.000% or less, Ni: 1.000% or less, Mo: 1.000% or less, Sb: 0.200% or less, Sn: 0.200% or less, Cu: 1.000% or less, Ta: 0.100% or less, W: 0.500% or less, Mg: 0.0200% or less, Zn: 0.0200% or less, Co: 0.0200% or less, Zr: 0.1000% or less, Ca: 0.0200% or less, Se: 0.0200% or less, Te: 0.0200% or less, Ge: 0.0200% or less, As: 0.0500% or less, Sr: 0.0200% or less, Cs: 0.0200% or less, Hf: 0.0200% or less, Pb: 0.0200% or less, Bi: 0.0200% or less, and REM: 0.0200% or less Nb: 0.200% or Less Nb forms fine carbide, nitride, or carbonitride during hot rolling or annealing and thereby increases TS, YS, and YR. To produce such effects, the Nb content is preferably 0.001% or more. The Nb content is more preferably 0.005% or more. On the other hand, a Nb content of more than 0.200% may result in a large number of coarse precipitates and inclusions. In such a case, a coarse precipitate or inclusion becomes a starting point of a void and a crack in a hole expansion test, a V-bending test, and a V-bending+orthogonal VDA bending test, and desired λ, R/t, and SFmax sometimes cannot be achieved. Thus, when Nb is contained, the Nb content is preferably 0.200% or less. The Nb content is more preferably 0.060% or less.

Ti: 0.200% or Less

Like Nb, Ti forms fine carbide, nitride, or carbonitride during hot rolling or annealing and thereby increases TS and YS. To produce such effects, the Ti content is preferably 0.001% or more. The Ti content is more preferably 0.005% or more. On the other hand, a Ti content of more than 0.200% may result in a large number of coarse precipitates and inclusions. In such a case, a coarse precipitate or inclusion becomes a starting point of a void and a crack in a hole expansion test, a V-bending test, and a V-bending+orthogonal VDA bending test, and desired A, R/t, and SFmax sometimes cannot be achieved. Thus, when Ti is contained, the Ti content is preferably 0.200% or less. The Ti content is more preferably 0.060% or less.

V: 0.200% or Less

Like Nb or Ti, V forms fine carbide, nitride, or carbonitride during hot rolling or annealing and thereby increases TS and YS. To produce such effects, the V content is preferably 0.001% or more. The V content is more preferably 0.005% or more. The V content is still more preferably 0.030% or more.

On the other hand, a V content of more than 0.200% may result in a large number of coarse precipitates and inclusions. In such a case, a coarse precipitate or inclusion becomes a starting point of a void and a crack in a hole expansion test, a V-bending test, and a V-bending+orthogonal VDA bending test, and desired A, R/t, and SFmax sometimes cannot be achieved. Thus, when V is contained, the V content is preferably 0.200% or less. The V content is more preferably 0.060% or less.

B: 0.0100% or Less

B is an element that segregates at an austenite grain boundary and enhances hardenability. B is also an element that controls the formation and grain growth of ferrite during cooling after annealing. To produce such effects, the B content is preferably 0.0001% or more. The B content is more preferably 0.0002% or more. The B content is still more preferably 0.0010% or more. On the other hand, a B content of more than 0.0100% may result in a crack in a steel sheet during hot rolling. The internal crack becomes a starting point of a crack in a hole expansion test, a V-bending test, and a V-bending+orthogonal VDA bending test, and desired A, R/t, and SFmax sometimes cannot be achieved. Thus, when B is contained, the B content is preferably 0.0100% or less. The B content is more preferably 0.0050% or less.

Cr: 1.000% or Less

Cr is an element that enhances hardenability, and the addition of Cr forms an appropriate amount of tempered martensite and increases TS and YS. To produce such effects, the Cr content is preferably 0.0005% or more. The Cr content is more preferably 0.010% or more. The Cr content is still more preferably 0.030% or more, still more preferably 0.200% or more. On the other hand, a Cr content of more than 1.000% may result in an increased area fraction of martensite, lower flangeability or bendability in a V-bending test, and undesired A and R/t. Thus, when Cr is contained, the Cr content is preferably 1.000% or less. The Cr content is more preferably 0.700% or less, still more preferably 0.600% or less.

Ni: 1.000% or Less

Ni is an element that enhances hardenability, and the addition of Ni forms a large amount of tempered martensite and increases TS and YS. To produce such effects, the Ni content is preferably 0.005% or more. The Ni content is more preferably 0.020% or more. The Ni content is still more preferably 0.080% or more, still more preferably 0.100% or more.

On the other hand, a Ni content of more than 1.000% may result in an increased area fraction of martensite, lower flangeability or bendability in a V-bending test, and undesired A and R/t. Thus, when Ni is contained, the Ni content is preferably 1.000% or less. The Ni content is more preferably 0.800% or less. The Ni content is still more preferably 0.600% or less, still more preferably 0.400% or less.

Mo: 1.000% or Less

Mo is an element that enhances hardenability, and the addition of Mo forms a large amount of tempered martensite and increases TS and YS. To produce such effects, the Mo content is preferably 0.010% or more. The Mo content is more preferably 0.030% or more. On the other hand, a Mo content of more than 1.000% may result in an increased area fraction of martensite, lower flangeability or bendability in a V-bending test, and undesired A and R/t. Thus, when Mo is contained, the Mo content is preferably 1.000% or less. The Mo content is more preferably 0.500% or less. The Mo content is still more preferably 0.450% or less, still more preferably 0.400% or less.

Sb: 0.200% or Less

Sb is an element that is effective in suppressing the diffusion of C near a surface of a steel sheet during annealing and in adjusting the thickness of a soft layer formed near the surface of the steel sheet. The Sb content is preferably 0.002% or more, more preferably 0.004% or more.

On the other hand, an Sb content of more than 0.200% may result in no soft layer near a surface of a steel sheet and lower λ, R/t, and SFmax. Thus, when Sb is contained, the Sb content is preferably 0.200% or less. The Sb content is more preferably 0.020% or less.

Sn: 0.200% or Less

Sn is an element that is effective in suppressing the diffusion of C near a surface of a steel sheet during annealing and in adjusting the thickness of a soft layer formed near the surface of the steel sheet. The Sn content is preferably 0.002% or more, more preferably 0.004% or more.

On the other hand, a Sn content of more than 0.200% may result in no soft layer near a surface of a steel sheet and lower λ, R/t, and SFmax. Thus, when Sn is contained, the Sn content is preferably 0.200% or less. The Sn content is more preferably 0.020% or less.

Cu: 1.000% or Less

Cu is an element that enhances hardenability, and the addition of Cu forms a large amount of tempered martensite and increases TS and YS. To produce such effects, the Cu content is preferably 0.005% or more. The Cu content is more preferably 0.020% or more. The Cu content is still more preferably 0.080% or more, still more preferably 0.150% or more.

On the other hand, a Cu content of more than 1.000% may result in an excessively increased area fraction of martensite. Furthermore, a large number of coarse precipitates and inclusions may be formed. In such a case, excessively formed martensite or a coarse precipitate or inclusion becomes a starting point of a void and a crack in a hole expansion test, a V-bending test, and a V-bending+orthogonal VDA bending test, and desired λ, R/t, and SFmax sometimes cannot be achieved. Thus, when Cu is contained, the Cu content is preferably 1.000% or less. The Cu content is more preferably 0.200% or less.

Ta: 0.100% or Less

Like Ti, Nb, and V, Ta forms fine carbide, nitride, or carbonitride during hot rolling or annealing and thereby increases TS and YS. Furthermore, Ta partially dissolves in Nb carbide or Nb carbonitride and forms a complex precipitate, such as (Nb, Ta) (C, N). This suppresses coarsening of a precipitate and stabilizes precipitation strengthening. This further improves TS and YS. To produce such effects, the Ta content is preferably 0.001% or more. On the other hand, a Ta content of more than 0.100% may result in a large number of coarse precipitates and inclusions. In such a case, an excessively coarse precipitate or inclusion becomes a starting point of a void and a crack in a hole expansion test, a V-bending test, and a V-bending+orthogonal VDA bending test, and desired λ, R/t, and SFmax sometimes cannot be achieved. Thus, when Ta is contained, the Ta content is preferably 0.100% or less. The Ta content is more preferably 0.080% or less, still more preferably 0.020% or less.

W: 0.500% or Less

W is an element that enhances hardenability, and the addition of W forms a large amount of tempered martensite and increases TS and YS. To produce such effects, the W content is preferably 0.001% or more. The W content is more preferably 0.030% or more. On the other hand, a W content of more than 0.500% may result in an increased area fraction of martensite, lower flangeability or bendability in a V-bending test, and undesired A and R/t. Thus, when W is contained, the W content is preferably 0.500% or less. The W content is more preferably 0.450% or less, still more preferably 0.400% or less. The W content is still more preferably 0.150% or less, still more preferably 0.080% or less.

Mg: 0.0200% or Less

Mg is an element that is effective in spheroidizing the shape of an inclusion of sulfide, oxide, or the like to improve the flangeability and bendability of a steel sheet. To produce such effects, the Mg content is preferably 0.0001% or more. The Mg content is more preferably 0.0005% or more, still more preferably 0.0020% or more.

On the other hand, a Mg content of more than 0.0200% may result in a large number of coarse precipitates and inclusions. In such a case, an excessively coarse precipitate or inclusion becomes a starting point of a void and a crack in a hole expansion test, a V-bending test, and a V-bending+orthogonal VDA bending test, and desired λ, R/t, and SFmax sometimes cannot be achieved. Thus, when Mg is contained, the Mg content is preferably 0.0200% or less. The Mg content is more preferably 0.0150% or less, still more preferably 0.0100% or less.

Zn: 0.0200% or Less

Zn is an element that is effective in spheroidizing the shape of an inclusion to improve the flangeability and bendability of a steel sheet. To produce such effects, the Zn content is preferably 0.0010% or more. The Zn content is more preferably 0.0005% or more, still more preferably 0.0020% or more.

On the other hand, a Zn content of more than 0.0200% may result in a large number of coarse precipitates and inclusions. In such a case, an excessively coarse precipitate or inclusion becomes a starting point of a void and a crack in a hole expansion test, a V-bending test, and a V-bending+orthogonal VDA bending test, and desired λ, R/t, and SFmax sometimes cannot be achieved. Thus, when Zn is contained, the Zn content is preferably 0.0200% or less. The Zn content is more preferably 0.0150% or less, still more preferably 0.0100% or less.

Co: 0.0200% or Less

Like Zn, Co is an element that is effective in spheroidizing the shape of an inclusion to improve the flangeability and bendability of a steel sheet. To produce such effects, the Co content is preferably 0.0010% or more. The Co content is more preferably 0.0010% or more, still more preferably 0.0020% or more.

On the other hand, a Co content of more than 0.0200% may result in a large number of coarse precipitates and inclusions. In such a case, an excessively coarse precipitate or inclusion becomes a starting point of a void and a crack in a hole expansion test, a V-bending test, and a V-bending+orthogonal VDA bending test, and desired λ, R/t, and SFmax sometimes cannot be achieved. Thus, when Co is contained, the Co content is preferably 0.0200% or less.

Zr: 0.1000% or Less

Like Zn and Co, Zr is an element that is effective in spheroidizing the shape of an inclusion to improve the flangeability and bendability of a steel sheet. To produce such effects, the Zr content is preferably 0.0010% or more.

On the other hand, when the Zr content is more than 0.1000%, in such a case, an excessively coarse precipitate or inclusion becomes a starting point of a void and a crack in a hole expansion test, a V-bending test, and a V-bending+orthogonal VDA bending test, and desired λ, R/t, and SFmax sometimes cannot be achieved. Thus, when Zr is contained, the Zr content is preferably 0.1000% or less. The Zr content is more preferably 0.0150% or less, still more preferably 0.0100% or less.

Ca: 0.0200% or Less

Ca is present as an inclusion in steel. A Ca content of more than 0.0200% may result in a large number of coarse inclusions. In such a case, an excessively coarse precipitate or inclusion becomes a starting point of a void and a crack in a hole expansion test, a V-bending test, and a V-bending+orthogonal VDA bending test, and desired λ, R/t, and SFmax sometimes cannot be achieved. Thus, when Ca is contained, the Ca content is preferably 0.0200% or less. The Ca content is preferably 0.0080% or less.

The Ca content may have any lower limit but is preferably 0.0005% or more. Due to constraints on production technology, the Ca content is more preferably 0.0010% or more.

Se: 0.0200% or less, Te: 0.0200% or less, Ge: 0.0200% or less, As: 0.0500% or less, Sr: 0.0200% or less, Cs: 0.0200% or less, Hf: 0.0200% or less, Pb: 0.0200% or less, Bi: 0.0200% or less, REM: 0.0200% or less Se, Te, Ge, As, Sr, Cs, Hf, Pb, Bi, and REM are elements effective in improving the flangeability and bendability of a steel sheet. To produce such effects, each of the Se, Te, Ge, As, Sr, Cs, Hf, Pb, Bi, and REM contents is preferably 0.0001% or more.

Each of the Se, Te, Ge, As, Sr, Cs, Hf, Pb, Bi, and REM contents is more preferably 0.0020% or more.

On the other hand, a Se, Te, Ge, Sr, Cs, Hf, Pb, Bi, or REM content of more than 0.0200% or an As content of more than 0.0500% may result in a large number of coarse precipitates and inclusions. In such a case, an excessively coarse precipitate or inclusion becomes a starting point of a void and a crack in a hole expansion test, a V-bending test, and a V-bending+orthogonal VDA bending test, and desired λ, R/t, and SFmax sometimes cannot be achieved. Thus, when at least one of Se, Te, Ge, As, Sr, Cs, Hf, Pb, Bi, and REM is contained, each of the Se, Te, Ge, Sr, Cs, Hf, Pb, Bi, and REM contents is preferably 0.0200% or less, and the As content is preferably 0.0500% or less.

Each of the Se, Te, Ge, As, Sr, Cs, Hf, Pb, Bi, and REM contents is more preferably 0.0120% or less.

The term "REM", as used herein, refers to scandium (Sc) with atomic number 21, yttrium (Y) with atomic number 39, and lanthanoids from lanthanum (La) with atomic number 57 to lutetium (Lu) with atomic number 71.

The REM concentration in accordance with aspects of the present invention refers to the total content of one or two or more elements selected from the REM.

REM is preferably, but not limited to, Sc, Y, Ce, or La.

Surface Soft Layer

Next, the steel microstructure of a base steel sheet according to an embodiment of the present invention is described.

A steel sheet according to an embodiment of the present invention has a surface soft layer on the surface of a base steel sheet (on a base (underlayer) for coating in the case of a hot-dip galvanized steel sheet, a hot-dip galvannealed steel sheet, an electrogalvanized steel sheet, or another metal coated steel sheet). The surface soft layer contributes to the suppression of the development of flex cracking during press forming and in case of a collision of an automobile body and therefore further improves bending fracture resistance characteristics. The surface soft layer refers to a decarburized layer and a surface layer region with a Vickers hardness of 85% or less with respect to the Vickers hardness of a cross section (a surface parallel to the surface of the steel sheet) at a quarter thickness position of the base steel sheet.

The surface soft layer is formed in a region of 200 μm or less from the surface of the base steel sheet in the thickness direction. The region where the surface soft layer is formed is preferably 150 μm or less, more preferably 120 μm or less, from the surface of the base steel sheet in the thickness direction. The region where the surface soft layer is formed is preferably 30 μm or more, more preferably 40 μm or more, from the surface of the base steel sheet in the thickness direction.

The quarter thickness position of the base steel sheet where the Vickers hardness is measured is a non-surface-soft layer (a layer that does not satisfy the condition of the hardness of the surface soft layer defined in accordance with aspects of the present invention).

The Vickers hardness is measured at a load of 10 gf in accordance with JIS Z 2244-1 (2020).

Hardness of Surface Soft Layer

When the nanohardness is measured at 300 points or more in a 50 μm×50 μm region on the sheet surface at each of the quarter depth position in the thickness direction and the half depth position in the thickness direction of the surface soft layer from the surface of the base steel sheet, the ratio of the number of measurements in which the nanohardness of the sheet surface at the quarter depth position in the thickness direction of the surface soft layer from the surface of the base steel sheet is 7.0 GPa or more is 0.10 or less with respect to the total number of measurements.

In accordance with aspects of the present invention, to achieve high bendability during press forming and good bending fracture characteristics in case of a collision, when the nanohardness is measured at 300 points or more in a 50 μm×50 μm region on the sheet surface at the quarter depth position in the thickness direction of the surface soft layer from the surface of the base steel sheet, the ratio of the nanohardness of 7.0 GPa or more on the sheet surface at the quarter depth position in the thickness direction of the surface soft layer from the surface of the base steel sheet should be 0.10 or less with respect to the total number of measurements (the total number of measurements at the quarter depth position in the thickness direction). When the ratio of the nanohardness of 7.0 GPa or more is 0.10 or less, it means a low ratio of a hard microstructure (martensite or the like), an inclusion, or the like, and this can further suppress the formation and connection of voids and the propagation of a crack of the hard microstructure (martensite and the like), inclusion, or the like during press forming and in case of a collision, thus resulting in high R/t and SFmax.

The ratio of the nanohardness of 7.0 GPa or more on the sheet surface at the quarter depth position in the thickness direction of the surface soft layer from the surface of the base steel sheet is preferably 0.08 or less, more preferably 0.07 or less, with respect to the total number of measurements. The lower limit may be, but is not limited to, 0.01 or more.

The nanohardness of the sheet surface at the quarter depth position in the thickness direction of the surface soft layer from the surface of the steel sheet has a standard deviation σ of 1.8 GPa or less, and the nanohardness of the sheet surface at the half depth position in the thickness direction of the surface soft layer from the surface of the steel sheet has a standard deviation σ of 2.2 GPa or less.

In accordance with aspects of the present invention, to achieve high bendability during press forming and good bending fracture characteristics in case of a collision, the nanohardness of the sheet surface at the quarter depth position in the thickness direction of the surface soft layer from the surface of the steel sheet should have a standard deviation σ of 1.8 GPa or less, and the nanohardness of the sheet surface at the half depth position in the thickness direction of the surface soft layer from the surface of the steel sheet should have a standard deviation σ of 2.2 GPa or less. When the nanohardness of the sheet surface at the quarter depth position in the thickness direction of the surface soft layer from the surface of the steel sheet has a standard deviation σ of 1.8 GPa or less, and the nanohardness of the sheet surface at the half depth position in the thickness direction of the surface soft layer from the surface of the steel sheet has a standard deviation σ of 2.2 GPa or less, this means a small difference in microstructure hardness in a micro region and can further suppress the formation and connection of voids and the propagation of a crack during press forming and in case of a collision, thus resulting in high R/t and SFmax.

The nanohardness of the sheet surface at the quarter depth position in the thickness direction of the surface soft layer from the surface of the base steel sheet preferably has a standard deviation σ of 1.7 GPa or less. The nanohardness of the sheet surface at the quarter depth position in the thickness direction of the surface soft layer from the surface of the base steel sheet more preferably has a standard deviation σ of 1.3 GPa or less. The standard deviation σ of the nanohardness of the sheet surface at the quarter depth position in the thickness direction of the surface soft layer from the surface of the base steel sheet may have any lower limit and may be 0.5 GPa or more.

The nanohardness of the sheet surface at the half depth position in the thickness direction of the surface soft layer from the surface of the base steel sheet preferably has a standard deviation σ of 2.1 GPa or less. The nanohardness of the sheet surface at the half depth position in the thickness direction of the surface soft layer from the surface of the base steel sheet more preferably has a standard deviation σ of 1.7 GPa or less. The standard deviation σ of the nanohardness of the sheet surface at the half depth position in the thickness direction of the surface soft layer from the surface of the base steel sheet may have any lower limit and may be 0.6 GPa or more.

The nanohardness of the sheet surface at the quarter depth position and at the half depth position in the thickness direction is measured by the following method.

First, when a coated layer is formed, the coated layer is peeled off. Subsequently, mechanical polishing is performed to (the quarter depth position in the thickness direction of the surface soft layer from the surface of the base steel sheet −5 μm), buffing with diamond and alumina is performed to the quarter depth position in the thickness direction of the surface soft layer from the surface of the base steel sheet, and colloidal silica polishing is further performed. The nanohardness is measured with Hysitron tribo-950 and a Berkovich diamond indenter under the conditions of a load of 500 μN, a measurement area of 50 μm×50 μm, and a dot-to-dot distance of 2 μm.

Furthermore, mechanical polishing is performed to the half depth position in the thickness direction of the surface soft layer, buffing with diamond and alumina is performed, and colloidal silica polishing is further performed. The nanohardness is measured with Hysitron tribo-950 and a Berkovich diamond indenter under the conditions of a load of 500 μN, a measurement area of 50 μm×50 μm, and a dot-to-dot distance of 2 μm.

The nanohardness is measured at 300 points or more at the quarter depth position in the thickness direction, and the nanohardness is measured at 300 points or more at the half depth position in the thickness direction.

For example, when the surface soft layer has a thickness of 100 μm, the quarter position is a position of 25 μm from the surface of the surface soft layer, and the half position is a position of 50 μm from the surface of the surface soft layer. The nanohardness is measured at 300 points or more at the position of 25 μm, and the nanohardness is measure at 300 points or more at the position of 50 μm.

The surface roughness depth of a test specimen after 90-degree V-bending in which R/t obtained by dividing the critical bending radius R by the sheet thickness t is 4.5 or more and 5.0 or less: 20.0 μm or less To further improve SFmax characteristic according to aspects of the present invention, it is effective to control the roughness of the surface of the steel sheet. A method for evaluating the roughness of the surface of the steel sheet is described below. A recessed portion of the roughness of the surface of the steel sheet is likely to be a flex cracking starting point. Thus, when the surface roughness depth of a test specimen after 90-degree V-bending in which R/t obtained by dividing the critical bending radius R by the sheet thickness t is 4.5 or more and 5.0 or less is more than 20.0 μm, desired R/t and SFmax under specified conditions may not be achieved. A metal coated layer mainly containing Fe or Ni (a first coated layer (a coated layer formed by coating treatment in a first coating step (a metal coating step))) contains an internal oxide present in the outermost surface layer and reduces the surface roughness depth of the test specimen after 90-degree V-bending in which R/t obtained by dividing the critical bending radius R by the sheet thickness t is 4.5 or more and 5.0 or less, thus resulting in higher R/t and SFmax. The surface roughness depth is preferably 12.0 μm or less, more preferably 9.0 μm or less. The lower limit may be, but is not limited to, 0.1 μm or more or 0.3 μm or more.

The surface roughness depth of a bending cross section is determined by photographing SEM images of the bending cross section at a magnification of 1500 times in five visual fields as shown in FIG. 1, drawing a reference line at the maximum height position of a surface raised portion and at the maximum depth position of a recessed portion of a microcrack portion in the range of 83 μm in the horizontal direction of the photograph, determining the shortest distance therebetween, and averaging the shortest distances on the SEM images in the five visual fields. The average value of the shortest distances thus determined is defined as the surface roughness depth.

The conditions for evaluating the surface roughness depth are different from the conditions for evaluating bendability according to JIS Z 2248, that is, evaluation criteria based on the presence or absence of cracking after bending.

Total area fraction of ferrite and bainite present in surface soft layer: 20% or more, and (area fraction of martensite present in surface soft layer)/(total area fraction of martensite and tempered martensite present in surface soft layer):0.45 or less When a surface soft layer is present, a starting point of the formation and connection of voids and the propagation of a crack during press forming and in case of a collision is the boundary between ferrite and bainite, which are soft phases in the surface soft layer, and martensite and tempered martensite, which are hard phases.

When the total area fraction of ferrite and bainite present in the surface soft layer is increased and when the area fraction of martensite present in the surface soft layer divided by the total area fraction of martensite and tempered martensite present in the surface soft layer is small, cracking during press forming and in case of a collision can be suppressed, and high R/t and SFmax can be achieved.

When the total area fraction of ferrite and bainite present in the surface soft layer is less than 20% and/or when the area fraction of martensite present in the surface soft layer divided by the total area fraction of martensite and tempered martensite present in the surface soft layer is more than 0.45, the formation and connection of voids and the propagation of a crack during press forming and in case of a collision may not be suppressed, and desired R/t and SFmax may not be achieved. Thus, the total area fraction of ferrite and bainite present in the surface soft layer is preferably 20% or more, and the area fraction of martensite present in the surface soft layer divided by the total area fraction of martensite and tempered martensite present in the surface soft layer is preferably 0.45 or less. It is more preferably 0.40 or less.

The area fraction of martensite present in the surface soft layer divided by the total area fraction of martensite and tempered martensite present in the surface soft layer may have any lower limit and may be 0.00. The total area fraction of ferrite and bainite present in the surface soft layer may have any upper limit and may be 100%.

Steel Microstructure at Quarter Thickness Position

Martensite preferably has an area fraction of 50.0% or less.

Martensite with an excessively increased area fraction becomes a starting point of the formation of a void in a hole expanding process in a hole expansion test or in a bending process in a V-bending test, and desired A and R/t may not be achieved. Thus, martensite preferably has an area fraction of 50.0% or less. Martensite more preferably has an area fraction of 45.0% or less. The area fraction of martensite may have any lower limit and may be 0.0%. The martensite referred to here is as-quenched (untempered) martensite.

Retained austenite preferably has a volume fraction of 20.0% or less.

Retained austenite with an excessively increased volume fraction may result in the formation of hard martensite by deformation-induced transformation of retained austenite when a steel sheet is punched in a hole expansion test and is subjected to V-bending in a V-bending+orthogonal VDA test, the formation of a void and the propagation of a crack in a subsequent test, and undesired desired A and SFmax. Thus, retained austenite preferably has a volume fraction of 20.0% or less.

Tempered martensite is a metal phase that can impart strength and workability to a steel sheet that is an object of aspects of the present invention and can have an area fraction of 100% or less as appropriate.

The remaining microstructure other than martensite, retained austenite, and tempered martensite is, for example, but not limited to, ferrite, unrecrystallized ferrite, pearlite, bainite, ε-martensite, or the like.

The type of the remaining microstructure can be determined, for example, by SEM observation.

The area fractions of ferrite, bainite, tempered martensite, and a hard second phase (martensite+retained austenite) are measured at a quarter thickness position of a base steel sheet as described below.

A sample is cut out to form a thickness cross section (L cross section) parallel to the rolling direction of a steel sheet as an observation surface. The observation surface of the sample is then polished with a diamond paste and is then subjected to final polishing with alumina. The observation surface of the sample is then etched with 3% by volume nital to expose the microstructure. The base steel sheet is then observed at a quarter thickness position using a SEM at a magnification of 3000 times in five visual fields. From a microstructure image thus taken, the area fraction is calculated by dividing the area of each constituent microstructure (ferrite, bainite, tempered martensite, and a hard second phase (martensite+retained austenite)) by the measurement area in five visual fields using Adobe Photoshop available from Adobe Systems, and the area fractions are averaged to determine the area fraction of each microstructure.

Ferrite is a massive black region. Almost no carbide is contained. The area fraction of ferrite does not include isolated island martensite and isolated island retained austenite in a ferrite grain.

Bainite is a black to dark gray region of a massive form, an indefinite form, or the like. A relatively small number of carbides are contained.

Tempered martensite is a gray region of an indefinite form. A relatively large number of carbides are contained.

A hard second phase (retained austenite+martensite) is a white to light gray region of an indefinite form. No carbide is contained.

A carbide is a dotted or linear white region. It is contained in bainite and tempered martensite.

A remaining microstructure is composed of, in addition to ferrite and bainite described above, pearlite, cementite, unrecrystallized ferrite, ε-martensite, and the like, which have a known form and the like.

The volume fraction of retained austenite is measured as described below.

A base steel sheet is mechanically ground to a quarter thickness position in the thickness direction (depth direction) and is then chemically polished with oxalic acid to form an observation surface. The observation surface is then observed by X-ray diffractometry. A MoKα radiation source is used for incident X-rays to determine the ratio of the diffraction intensity of each of (200), (220), and (311) planes of fcc iron (austenite) to the diffraction intensity of each of (200), (211), and (220) planes of bcc iron. The volume fraction of retained austenite is calculated from the ratio of the diffraction intensity of each plane. On the assumption that retained austenite is three-dimensionally homogeneous, the volume fraction of retained austenite is defined as the area fraction of the retained austenite.

The area fraction of martensite is determined by subtracting the area fraction of retained austenite from the area fraction of the hard second phase determined as described above.

[Area fraction of martensite (%)]=[area fraction of hard second phase (%)]−[area fraction of retained austenite (%)]

The area fraction of the remaining microstructure is determined by subtracting the area fraction of ferrite, the area fraction of bainite, the area fraction of tempered martensite, and the area fraction of the hard second phase, which are determined as described above, from 100.0%.

[Area fraction of remaining microstructure (%)]=100.0−[area fraction of ferrite (%)]−[area fraction of bainite (%)]−[area fraction of tempered martensite (%)]−[area fraction of hard second phase (%)]

The microstructure (ferrite, bainite, martensite, and tempered martensite) present in the surface soft layer is measured in the same manner as the microstructure at the quarter thickness position of the base steel sheet described above except that the observation position is the quarter depth position in the thickness direction of the surface soft layer instead of the quarter thickness position of the base steel sheet.

Next, mechanical properties of a steel sheet according to an embodiment of the present invention are described.

Tensile Strength (TS): 590 MPa or More

A steel sheet according to an embodiment of the present invention has a tensile strength TS of 590 MPa or more.

The yield stress (YS), the total elongation (El), the limiting hole expansion ratio (A), the critical bending radius/thickness (R/t), the stroke at the maximum load (SFmax) in a V-bending+orthogonal VDA bending test, and the presence or absence of fracture (appearance crack) in an axial crushing test of a steel sheet according to an embodiment of the present invention are as described above.

The tensile strength (TS), the yield stress (YS), and the total elongation (El) are measured in a tensile test according to JIS Z 2241 described later in Examples. The limiting hole expansion ratio (A) is measured in a hole expansion test according to JIS Z 2256 described later in Examples. The critical bending radius/thickness (R/t) is measured in a V-bending test according to JIS Z 2248 described later in Examples. The stroke at the maximum load (SFmax) in the V-bending+orthogonal VDA bending test is measured in a V-bending+orthogonal VDA bending test described later in Examples. The presence or absence of fracture (appearance crack) in the axial crushing test is measured in an axial crushing test described later in Examples.

First Coated Layer

A steel sheet according to an embodiment of the present invention preferably has a metal coated layer (first coated layer, precoated layer) on one or both surfaces of a base steel sheet (the metal coated layer (first coated layer) excludes a hot-dip galvanized layer, a hot-dip galvannealed layer, a galvanized layer of an electrogalvanized layer, and a hot-dip aluminum coated layer). The metal coated layer is preferably a metal electroplated layer, and the metal electroplated layer is described below as an example.

When the metal electroplated layer is formed on the surface of a steel sheet, the metal electroplated layer as the outermost surface layer contributes to the suppression of the occurrence of flex cracking during press forming and in case of a collision of an automobile body and therefore further improves the bending fracture resistance characteristics.

The metal species of the metal electroplated layer may be any of Cr, Mn, Fe, Co, Ni, Cu, Ga, Ge, As, Ru, Rh, Pd, Ag, Cd, In, Sn, Sb, Os, Ir, Pt, Au, Hg, Ti, Pb, and Bi and is preferably Fe. Although an Fe-based electroplated layer is described below as an example, the following conditions for Fe can be similarly employed for other metal species.

The coating weight of the Fe-based electroplated layer is more than 0 g/m$^2$, preferably 2.0 g/m$^2$ or more. The upper limit of the coating weight per side of the Fe-based electroplated layer is not particularly limited, and from the perspective of cost, the coating weight per side of the Fe-based electroplated layer is preferably 60 g/m$^2$ or less. The coating weight of the Fe-based electroplated layer is preferably 50 g/m$^2$ or less, more preferably 40 g/m$^2$ or less, still more preferably 30 g/m$^2$ or less.

The coating weight of the Fe-based electroplated layer is measured as described below. A sample with a size of 10×15 mm is taken from the Fe-based electroplated steel sheet and is embedded in a resin to prepare a cross-section embedded sample. Three arbitrary places on the cross section are observed with a scanning electron microscope (SEM) at an acceleration voltage of 15 kV and at a magnification of 2,000 to 10,000 times depending on the thickness of the Fe-based coated layer. The average value of the thicknesses in the three visual fields is converted into the coating weight per side of the Fe-based coated layer by multiplying it by the density of iron.

The Fe-based electroplated layer may be, in addition to pure Fe, an alloy coated layer, such as an Fe—B alloy, an Fe—C alloy, an Fe—P alloy, an Fe—N alloy, an Fe—O alloy, an Fe—Ni alloy, an Fe—Mn alloy, an Fe—Mo alloy, or an Fe—W alloy. The Fe-based electroplated layer may have any chemical composition and preferably has a chemical composition containing 10% by mass or less in total of one or two or more elements selected from the group consisting of B, C, P, N, O, Ni, Mn, Mo, Zn, W, Pb, Sn, Cr, V, and Co, with the remainder being Fe and incidental impurities. When the total amount of elements other than Fe is 10% by mass or less, this can prevent a decrease in electrolysis efficiency and can form an Fe-based electroplated layer at low cost. For an Fe—C alloy, the C content is preferably 0.08% by mass or less.

Second Coated Layer

A steel sheet according to an embodiment of the present invention may have a coated layer (a second coated layer, such as a galvanized layer or an aluminum coated layer) on the outermost surface layer of one or both surfaces of the steel sheet, and the coated layer may be a hot-dip galvanized layer, a hot-dip galvannealed layer, an electrogalvanized layer, a hot-dip aluminum coated layer, or the like.

A coated layer of a hot-dip galvanized steel sheet with a hot-dip galvanized layer formed on the surface of the steel sheet, a hot-dip galvannealed steel sheet with a hot-dip galvannealed layer formed on the surface of the steel sheet, an electrogalvanized steel sheet with an electrogalvanized layer formed on the surface of the steel sheet, and a coated steel sheet with another metal coated layer (such as an aluminum coated layer) formed on the surface of the steel sheet may be provided only on one surface of a base steel sheet (on the surface of the base steel sheet or on the surface of a metal coated layer when the metal coated layer is formed) or may be provided on both surfaces.

Thus, a steel sheet according to aspects of the present invention may have a base steel sheet and a second coated layer (a galvanized layer, an aluminum coated layer, or the like) formed on the base steel sheet or may have a base steel sheet and a metal coated layer (a first coated layer (excluding a second coated layer, such as a galvanized layer or an aluminum coated layer)) and a second coated layer (a galvanized layer, an aluminum coated layer, or the like) sequentially formed on the base steel sheet.

A coated layer of a hot-dip galvanized steel sheet, a hot-dip galvannealed steel sheet, or an electrogalvanized steel sheet as used herein refers to a coated layer containing Zn (zinc) as a main component (with a Zn content of 50.0% by mass or more).

A coated layer of an aluminum coated steel sheet refers to a coated layer containing Al (aluminum) as a main component (with an Al content of 50.0% by mass or more).

A hot-dip galvanized layer is preferably composed of, for example, Zn, 20.0% by mass or less of Fe, and 0.001% by mass or more and 1.0% by mass or less of Al. A hot-dip galvanized layer may optionally contain one or two or more elements selected from the group consisting of Pb, Sb, Si, Sn, Mg, Mn, Ni, Cr, Co, Ca, Cu, Li, Ti, Be, Bi, and REM in a total amount of 0.0% by mass or more and 3.5% by mass or less. A hot-dip galvanized layer more preferably has an Fe content of less than 7.0% by mass. The remainder other than these elements is incidental impurities.

A hot-dip galvannealed layer is preferably composed of, for example, 20% by mass or less of Fe and 0.001% by mass or more and 1.0% by mass or less of Al. A hot-dip galvannealed layer may optionally contain one or two or more elements selected from the group consisting of Pb, Sb, Si, Sn, Mg, Mn, Ni, Cr, Co, Ca, Cu, Li, Ti, Be, Bi, and REM in a total amount of 0.0% by mass or more and 3.5% by mass or less. A hot-dip galvannealed layer more preferably has an Fe content of 7.0% by mass or more, still more preferably 8.0% by mass or more. A hot-dip galvannealed layer more preferably has an Fe content of 15.0% by mass or less, still more preferably 12.0% by mass or less. The remainder other than these elements is incidental impurities.

Furthermore, the coating weight per side of a galvanized layer is preferably, but not limited to, 20 g/m$^2$ or more. The coating weight per side of a galvanized layer is preferably 80 g/m$^2$ or less.

The coating weight of a galvanized layer of a hot-dip galvanized steel sheet or a hot-dip galvannealed steel sheet is measured as described below.

A treatment liquid is prepared by adding 0.6 g of a corrosion inhibitor for Fe ("IBIT 700BK" (registered trademark) manufactured by Asahi Chemical Co., Ltd.) to 1 L of 10% by mass aqueous hydrochloric acid. A hot-dip galvanized steel sheet as a sample is immersed in the treatment liquid to dissolve a galvanized layer. The mass loss of the sample due to the dissolution is measured and is divided by the surface area of a base steel sheet (the surface area of a coated portion) to calculate the coating weight ($g/m^2$).

The thickness of a steel sheet according to an embodiment of the present invention is preferably, but not limited to, 0.5 mm or more. The thickness is preferably 3.5 mm or less. The thickness is more preferably 2.3 mm or less.

The thickness is more preferably 0.8 mm or more. The thickness is still more preferably 1.0 mm or more. The thickness is still more preferably 1.2 mm or more.

[2. Method for Producing Steel Sheet]

Next, a method for producing a steel sheet according to an embodiment of the present invention is described.

A method for producing a steel sheet according to aspects of the present invention includes: a hot-rolling step of hot-rolling a steel slab with the chemical composition described above; an annealing step of annealing the resulting steel sheet in an atmosphere with an annealing temperature of an $Ac_1$ point or more and 950° C. or less, an annealing time of 10 seconds or more, and a dew-point temperature of −30° C. or more; a first cooling step of cooling the steel sheet after the annealing step in a temperature range of the $Ac_1$ point to 450° C., in an atmosphere with a dew-point temperature of −30° C. or less, and at an average cooling rate of 8° C./s or more; and a second cooling step of cooling the steel sheet after the first cooling step at an average cooling rate of less than 8° C./s in a temperature range of less than 450° C. to 300° C.

In accordance with aspects of the present invention, a steel material (steel slab) can be melted by any method, for example, by a known melting method using a converter, an electric arc furnace, or the like. To prevent macrosegregation, a steel slab (slab) is preferably produced by continuous casting but may also be produced by ingot casting, thin slab casting, or the like. After a steel slab is produced, the steel slab may be cooled to room temperature and subsequently reheated by a known method. Alternatively, without cooling to room temperature, a steel slab may be subjected without problems to an energy-saving process, such as hot charge rolling or hot direct rolling, in which a hot slab is conveyed directly into a furnace or is immediately rolled after short heat retention.

(Hot Rolling Step)

When a slab is heated, the slab heating temperature is preferably 1100° C. or more from the perspective of dissolution of a carbide, a decrease in rolling force, and an improvement in the uniformity of the formation of a surface soft layer characteristic according to aspects of the present invention. The slab heating temperature is preferably 1300° C. or less to prevent an increase in scale loss. A slab heating temperature of 1300° C. or less can prevent an excessive increase in the formation of a surface soft layer characteristic according to aspects of the present invention and stably achieve the strength characteristic according to aspects of the present invention.

The slab heating temperature is the surface temperature of the slab. A slab is formed into a sheet bar by rough rolling under typical conditions. At a low heating temperature, from the perspective of avoiding a trouble during hot rolling, the sheet bar is preferably heated with a bar heater or the like before finish rolling.

The finish rolling temperature is preferably 820° C. or more because the ductility, flangeability, and bendability of a final material can be reduced as a result of an increase in rolling load or an increase in rolling reduction in an unrecrystallized state of austenite and development of an abnormal microstructure elongated in the rolling direction. The coiling temperature after hot rolling is preferably 300° C. or more because the ductility, flangeability, and bendability of a final material may be reduced. The coiling temperature is preferably 700° C. or less.

For coiling after hot rolling, the coiling temperature is preferably 400° C. or more from the perspective of improving the uniformity of the formation of a surface soft layer characteristic according to aspects of the present invention. The coiling temperature is preferably 650° C. or less. At a coiling temperature of less than 400° C., it may be difficult to stably form a surface soft layer in the range specified in accordance with aspects of the present invention. A coiling temperature of more than 650° C. may make it difficult to stably achieve the strength characteristic according to aspects of the present invention due to an excessive increase in the formation of a surface soft layer characteristic according to aspects of the present invention. Thus, the coiling temperature is more preferably 400° C. or more. The coiling temperature is preferably 650° C. or less.

Rough-rolled sheet bars may be joined together during hot rolling to continuously perform finish rolling. A rough-rolled sheet bar may be coiled once. Furthermore, to reduce the rolling force during hot rolling, finish rolling may be partly or entirely rolling with lubrication. Rolling with lubrication is also effective in making the shape and the material quality of a steel sheet uniform. The friction coefficient in rolling with lubrication is preferably 0.10 or more. The friction coefficient in rolling with lubrication is preferably 0.25 or less.

(Pickling Step)

A hot-rolled steel sheet thus produced may be pickled. Pickling can remove an oxide from the surface of a steel sheet and can therefore be performed to ensure high chemical convertibility and quality of coating of a high-strength steel sheet of the final product. Pickling may be performed once or may be divided into a plurality of times.

(Cold Rolling Step)

A pickled sheet after hot rolling or a hot-rolled steel sheet thus produced is cold-rolled as required. For cold rolling, after hot rolling, a pickled sheet may be directly cold-rolled or may be cold-rolled after heat treatment. Optionally, a cold-rolled steel sheet after cold rolling may be pickled.

The cold rolling is, for example, multi-pass rolling requiring two or more passes, such as tandem multi-stand rolling or reverse rolling.

Rolling reduction in cold rolling: 20% or more and 80% or less

For cold rolling, the rolling reduction (cumulative rolling reduction ratio) in the cold rolling is preferably, but not limited to, 20% or more. The rolling reduction in cold rolling is preferably 80% or less. A rolling reduction of less than 20% in cold rolling tends to result in coarsening or a lack of uniformity of the steel microstructure in an annealing step and may result in the final product with lower TS or bendability. On the other hand, a rolling reduction of more than 80% in cold rolling tends to result in a steel sheet with a poor shape and may result in an uneven coating weight of coating, such as galvanizing.

(Metal coating (Metal Electroplated Coating, First Coating) Step)

An embodiment of the present invention may include a first coating step of performing metal coating on one or both surfaces of a steel sheet after the hot rolling step (after a cold rolling step when cold rolling is performed) and before an annealing step to form a first coated layer.

For example, the surface of a cold-rolled steel sheet produced as described above may be subjected to metal coating treatment (first coating treatment), such as metal electroplated coating treatment, to produce a metal electroplated steel sheet before annealing in which a metal electroplated layer before annealing (first coated layer) is formed on at least one surface. The metal coating referred to herein excludes second coating, such as galvanizing or aluminum coating. Although the metal electroplated coating treatment method is not particularly limited, as described above, a metal coated layer formed on a base steel sheet is preferably a metal electroplated layer, and the metal electroplated coating treatment is therefore preferably performed. For example, a sulfuric acid bath, a hydrochloric acid bath, a mixture of both, or the like can be used as an Fe-based electroplated coating bath. The coating weight of a metal electroplated layer before annealing can be adjusted by the energization time or the like. The metal electroplated steel sheet before annealing means that the metal electroplated layer is not subjected to an annealing step, and does not exclude a hot-rolled steel sheet before metal electroplated coating treatment, a pickled sheet after hot rolling, or a cold-rolled steel sheet each annealed in advance.

A metal species of an electroplated layer may be any of Cr, Mn, Fe, Co, Ni, Cu, Ga, Ge, As, Ru, Rh, Pd, Ag, Cd, In, Sn, Sb, Os, Ir, Pt, Au, Hg, Ti, Pb, and Bi and is preferably Fe. Thus, a method for producing an Fe-based electroplated coating is described below.

The Fe ion content of an Fe-based electroplated coating bath before the start of energization is preferably 0.5 mol/L or more in terms of $Fe^{2+}$. When the Fe ion content of an Fe-based electroplated coating bath is 0.5 mol/L or more in terms of $Fe^{2+}$, a sufficient Fe coating weight can be obtained. To obtain a sufficient Fe coating weight, the Fe ion content of the Fe-based electroplated coating bath before the start of energization is preferably 2.0 mol/L or less.

The Fe-based electroplated coating bath may contain an Fe ion and at least one element selected from the group consisting of B, C, P, N, O, Ni, Mn, Mo, Zn, W, Pb, Sn, Cr, V, and Co. The total content of these elements in the Fe-based electroplated coating bath is preferably such that the total content of these elements in an Fe-based electroplated layer before annealing is 10% by mass or less. A metal element may be contained as a metal ion, and a non-metal element can be contained as part of boric acid, phosphoric acid, nitric acid, an organic acid, or the like. An iron sulfate coating solution may contain a conduction aid, such as sodium sulfate or potassium sulfate, a chelating agent, or a pH buffer.

Other conditions of the Fe-based electroplated coating bath are also not particularly limited. The temperature of an Fe-based electroplated coating solution is preferably 30° C. or more and 85° C. or less in view of constant temperature retention ability. The pH of the Fe-based electroplated coating bath is also not particularly limited, is preferably 1.0 or more from the perspective of preventing a decrease in current efficiency due to hydrogen generation, and is preferably 3.0 or less in consideration of the electrical conductivity of the Fe-based electroplated coating bath. The electric current density is preferably 10 $A/dm^2$ or more from the perspective of productivity and is preferably 150 $A/dm^2$ or less from the perspective of facilitating the control of the coating weight of an Fe-based electroplated layer. The threading speed is preferably 5 mpm or more from the perspective of productivity and is preferably 150 mpm or less from the perspective of stably controlling the coating weight.

Degreasing treatment and water washing for cleaning the surface of a steel sheet and pickling treatment and water washing for activating the surface of the steel sheet can be performed as a treatment before Fe-based electroplated coating treatment. These pretreatments are followed by Fe-based electroplated coating treatment. The degreasing treatment and water washing may be performed by any method, for example, by a usual method. In the pickling treatment, various acids, such as sulfuric acid, hydrochloric acid, nitric acid, and mixtures thereof can be used. Among them, sulfuric acid, hydrochloric acid, or a mixture thereof is preferred. The acid concentration is not particularly limited and preferably ranges from 1% to 20% by mass in consideration of the capability of removing an oxide film, prevention of a rough surface (surface defect) due to overpickling, and the like. A pickling treatment liquid may contain an antifoaming agent, a pickling accelerator, a pickling inhibitor, or the like.

(Annealing Step)

After the hot rolling step (after a cold rolling step when cold rolling is performed, or after a first coating step when a first coating treatment for forming a first coated layer is performed), an embodiment of the present invention includes an annealing step of annealing a steel sheet at an annealing temperature of an $Ac_1$ point or more and 950° C. or less, for an annealing time of 10 seconds or more, and in an atmosphere with a dew-point temperature of −30° C. or more.

Annealing Temperature: $Ac_1$ Point (° C.) or More and 950° C. or Less

An annealing temperature lower than the $Ac_1$ point (° C.) results in an insufficient ratio of austenite formed during annealing. This excessively increases the area fraction of ferrite at a quarter thickness position after annealing and results in undesired TS and YS. On the other hand, an annealing temperature of more than 950° C. makes it difficult to form a surface soft layer due to an austenite single phase region. Thus, the annealing temperature is $Ac_1$ point (° C.) or more and 950° C. or less. The annealing temperature is preferably $Ac_1$ point+10° C. or more. It is preferably 900° C. or less. It is more preferably 840° C. or less. The annealing temperature is the highest temperature reached in the annealing step.

Annealing Time: 10 Seconds or More

An annealing time of less than 10 seconds makes it difficult to form a surface soft layer. Thus, the annealing time is 10 seconds or more. The upper limit of the annealing time is preferably, but not limited to, 900 seconds or less. The annealing time is the holding time in the temperature range of (annealing temperature-30° C.) or more and the annealing temperature or less. Thus, the annealing time includes, in addition to the holding time at the annealing temperature, the residence time in the temperature range of (annealing temperature-30° C.) or more and the annealing temperature or less in heating and cooling before and after reaching the annealing temperature.

The number of annealing may be two or more but is preferably one from the perspective of energy efficiency.

Dew-Point Temperature of Atmosphere in Annealing Step (Annealing Atmosphere): −30° C. or More The dew-point temperature of the atmosphere in the annealing step (annealing atmosphere) needs to be −30° C. or more. When the dew-point temperature of the annealing atmosphere in the annealing step is −30° C. or more, a decarburization reaction is promoted, and a surface soft layer is formed more deeply. As a result, when the nanohardness is measured at 300 points or more in a 50 μm×50 μm region on a sheet surface at a quarter depth position in the thickness direction of a surface soft layer from the surface of a base steel sheet, the ratio of a nanohardness of 7.0 GPa or more is 0.10 or less. The annealing atmosphere in the annealing step is preferably −15° C. or more, more preferably −5° C. or more. The dew-point temperature of the annealing atmosphere in the annealing step may have any upper limit and is preferably 30° C. or less in order to suitably prevent oxidation of the surface of an Fe-based electroplated layer and to improve the coating adhesion when a galvanized layer is provided.

(First Cooling Step)

In the temperature range of the $Ac_1$ point to 450° C., dew-point temperature: −30° C. or less, and average cooling rate (first average cooling rate): 8° C./s or more In accordance with aspects of the present invention, when the area fraction of ferrite at a quarter depth position in the thickness direction of a surface soft layer from the surface of a base steel sheet and at a half depth position in the thickness direction of the surface soft layer from the surface of the base steel sheet is increased, the nanohardness of the sheet surface at the quarter depth position in the thickness direction of the surface soft layer from the surface of the base steel sheet has a standard deviation σ of 1.8 GPa or less, and the nanohardness of the sheet surface at the half depth position in the thickness direction of the surface soft layer from the surface of the base steel sheet has a standard deviation σ of 2.2 GPa or less.

In this regard, when the average cooling rate in the temperature range of the $Ac_1$ point to 450° C. in the first cooling step after the annealing step is less than 8° C./s, the nanohardness cannot be adjusted to the above range. Thus, in accordance with aspects of the present invention, in the first cooling step after the annealing step, the average cooling rate in the temperature range of the $Ac_1$ point to 450° C. is 8° C./s or more.

It is also necessary that cooling in the temperature range of the $Ac_1$ point to 450° C. is performed in an atmosphere with a dew-point temperature of −30° C. or less. When the dew-point temperature is more than −30° C., a surface soft layer on the surface of a steel sheet is unevenly formed in the steel sheet, and cases are likely to occur that do not satisfy the specification of aspects of the present invention that the nanohardness of the sheet surface at the quarter depth position in the thickness direction of the surface soft layer from the surface of the base steel sheet has a standard deviation σ of 1.8 GPa or less, and the nanohardness of the sheet surface at the half depth position in the thickness direction of the surface soft layer from the surface of the base steel sheet has a standard deviation σ of 2.2 GPa or less. The lower limit of the dew-point temperature is not particularly limited and is preferably −55° C. or more due to equipment constraints. Cooling in the temperature range of the $Ac_1$ point to 450° C. is preferably performed in an atmosphere with a dew-point temperature of −32° C. or less.

The first average cooling rate (° C./s) can be calculated by "cooling start temperature ($Ac_1$ point)−cooling end temperature (450° C.)/cooling time (s)" in the first cooling step.

The $Ac_1$ point (° C.) can be calculated using the following formula:

$$Ac_1 \text{ point } (^\circ\text{C.}) = 727.0 - 32.7 \times [\%\ \text{C}] + 14.9 \times [\%\ \text{Si}] + 2.0 \times [\%\ \text{Mn}]$$

wherein [% C] denotes the C content, [% Si] denotes the Si content, and [% Mn] denotes the Mn content.

(Second Cooling Step)

Average cooling rate (second average cooling rate) in temperature range of less than 450° C. to 300° C.: less than 8° C./s In accordance with aspects of the present invention, when the area fraction of a martensite or retained austenite hard phase at a quarter depth position in the thickness direction of a surface soft layer from the surface of a base steel sheet and at a half depth position in the thickness direction of the surface soft layer from the surface of the base steel sheet is decreased, the nanohardness of the sheet surface at the quarter depth position in the thickness direction of the surface soft layer from the surface of the base steel sheet has a standard deviation σ of 1.8 GPa or less, and the nanohardness of the sheet surface at the half depth position in the thickness direction of the surface soft layer from the surface of the base steel sheet has a standard deviation σ of 2.2 GPa or less.

In this regard, when the average cooling rate in the temperature range of less than 450° C. to 300° C. in the second cooling step after the annealing step is 8° C./s or more, the nanohardness cannot be adjusted to the above range. Thus, in accordance with aspects of the present invention, in the second cooling step after the annealing step, the average cooling rate in the temperature range of less than 450° C. to 300° C. is less than 8° C./s.

The second average cooling rate (° C./s) can be calculated by "cooling start temperature (less than 450° C.)−cooling end temperature (300° C.)/cooling time (s)" in the second cooling step.

(Coating Step (Second Coating Step))

An embodiment of the present invention may include a second coating step of performing coating treatment on a steel sheet after the second cooling step to form a second coated layer.

The coating step (second coating step) is preferably a galvanizing step or hot-dip aluminum coating treatment, and galvanizing treatment in the galvanizing step is, for example, hot-dip galvanizing treatment, galvannealing treatment, or electrogalvanizing treatment.

In the hot-dip galvanizing treatment, preferably, a steel sheet is immersed in a galvanizing bath at 440° C. or more, and the coating weight is then adjusted by gas wiping or the like. In the above treatment, a steel sheet is preferably immersed in a galvanizing bath at 500° C. or less. The hot-dip galvanizing bath is not particularly limited as long as the galvanized layer has the composition described above. For example, the galvanizing bath preferably has a composition with an Al content of 0.10% by mass or more, the remainder being Zn and incidental impurities. The Al content is preferably 0.23% by mass or less.

In the galvannealing treatment, after the hot-dip galvanizing treatment described above, a steel sheet with a hot-dip galvanized layer (hot-dip galvanized steel sheet) is preferably heated to an alloying temperature of 450° C. or more to perform alloying treatment. The alloying temperature is preferably 600° C. or less. An alloying temperature of less than 450° C. may result in a low Zn—Fe alloying speed and make alloying difficult. On the other hand, an alloying temperature of more than 600° C. results in transformation of non-transformed austenite into pearlite and makes it difficult to achieve a TS of 590 MPa or more. The alloying temperature is more preferably 510° C. or more. The alloying temperature is more preferably 570° C. or less.

The coating weight of each of a steel sheet with a hot-dip galvanized layer (hot-dip galvanized steel sheet) (GI) and a steel sheet with a hot-dip galvannealed layer (hot-dip galvannealed steel sheet) (GA) is preferably 20 g/m$^2$ or more per side. The coating weight per side of a galvanized layer is preferably 80 g/m$^2$ or less. The coating weight can be adjusted by gas wiping or the like.

When hot-dip aluminum coating treatment is performed as a specific example of another metal coating treatment, a cold-rolled steel sheet produced by the cold-rolled steel sheet annealing is immersed in an aluminum coating bath at 660° C. or more to perform the hot-dip aluminum coating treatment, and the coating weight is then adjusted by gas wiping or the like. The temperature of the aluminum coating bath is preferably 730° C. or less.

Furthermore, when electrogalvanizing treatment is performed, the film thickness is preferably, but not limited to, 2 μm or more. The film thickness is preferably 15 μm or less.

(Reheating and Holding Step)

After the second cooling step (after the second coating step when second coating treatment is performed), if necessary, the steel sheet may be cooled to a cooling stop temperature in the range of 250° C. or less to room temperature in a reheating and holding step. This transforms part of non-transformed austenite in the surface soft layer into martensite. Furthermore, in the reheating and holding step, the steel sheet may be reheated to a reheating temperature range of (cooling stop temperature+50° C.) to 450° C. and held in the reheating temperature range for 10 seconds or more. This tempers the martensite in the surface soft layer, reduces the area fraction of martensite in the surface soft layer, and increases the area fraction of tempered martensite in the surface soft layer. The steel microstructure at a quarter thickness position of the base steel sheet is also tempered by reheating and holding, and YS and A increase.

The room temperature is preferably 1° C. or more. The room temperature is preferably 50° C. or less, more preferably 29° C. or less.

A cooling method after the second cooling step or further after the reheating and holding step can be, for example, gas jet cooling, mist cooling, roll cooling, water cooling, natural cooling, or the like. From the perspective of preventing surface oxidation, cooling is preferably performed to 250° C. or less. The average cooling rate is preferably, for example, 1° C./s or more and 50° C./s or less.

The steel sheet thus produced may be further subjected to temper rolling. When the rolling reduction in the temper rolling is more than 2.00%, the yield stress may increase, and the dimensional accuracy may decrease when the steel sheet is formed into a member. Thus, the rolling reduction in the temper rolling is preferably 2.00% or less. The lower limit of the rolling reduction in the temper rolling is preferably, but not limited to, 0.05% or more from the perspective of productivity. The temper rolling may be performed with an apparatus coupled to an annealing apparatus for each step (on-line) or with an apparatus separated from the annealing apparatus for each step (off-line). The number of times of temper rolling may be one or two or more. The rolling may be performed with a leveler or the like, provided that the elongation can be equivalent to that in the temper rolling.

Other conditions of the production method are not particularly limited and, from the perspective of productivity, a series of these treatments, such as annealing, hot-dip galvanizing, and alloying treatment of galvanizing, are preferably performed in a continuous galvanizing line (CGL), which is a hot-dip galvanizing line. After the hot-dip galvanizing, the coating weight can be adjusted by wiping. Conditions for coating and the like other than these conditions may be based on a usual method for hot-dip galvanizing.

[3. Member]

Next, a member according to an embodiment of the present invention is described.

A member according to an embodiment of the present invention is a member produced by using the steel sheet described above (as a material). For example, the steel sheet as a material is subjected to at least one of forming and joining to produce a member.

The steel sheet has a TS of 590 MPa or more, high YS, high press formability (ductility, flangeability, and bendability), and fracture resistance characteristics (axial crushing characteristics) in case of a collision. Thus, a member according to an embodiment of the present invention has high strength, high press formability, and good anti-crash property. Thus, a member according to an embodiment of the present invention is suitable for an impact energy absorbing member used in the automotive field.

[4. Method of Producing Member]

Next, a method for producing a member according to an embodiment of the present invention is described.

A method for producing a member according to an embodiment of the present invention includes a step of subjecting the steel sheet to at least one of forming and joining to produce a member.

A forming method is, for example, but not limited to, a general processing method, such as press working. A joining method is also, for example, but not limited to, typical welding, such as spot welding, laser welding, or arc welding, riveting, caulking, or the like. The forming conditions and the joining conditions are not particularly limited and may be based on a usual method.

Examples

A steel material with the chemical composition (the remainder being Fe and incidental impurities) listed in Table 1 was produced by steelmaking in a converter and was formed into a steel slab in a continuous casting method. In Table 1, "-" indicates the content at the level of incidental impurities.

The calculated transformation point, the $Ac_1$ point, in Table 1 is calculated using the following formula:

$$Ac_1 \text{ point } (^\circ \text{ C.}) = 727.0 - 32.7 \times [\%\ \text{C}] + 14.9 \times [\%\ \text{Si}] + 2.0 \times [\%\ \text{Mn}]$$

wherein [% C] denotes the C content, [% Si] denotes the Si content, and [% Mn] denotes the Mn content.

The steel slab was heated to 1200° C. and was then subjected to rough rolling and hot rolling to produce a hot-rolled steel sheet. The coiling temperature after hot-rolling was 500° C. Hot-rolled steel sheet Nos. 1 to 96 and Nos. 107 to 146 thus produced were subjected to pickling and cold rolling to produce cold-rolled steel sheets with thicknesses shown in Tables 2 to 4.

The hot-rolled steel sheet Nos. 97 to 106 were subjected to pickling to produce hot-rolled steel sheets (pickled) with thicknesses shown in Table 3. The cold-rolled steel sheets or hot-rolled steel sheets (pickled) were subjected to the treatments in the first coating step (metal coating step), the annealing step, the first cooling step, the second cooling step, and the coating step (second coating step) under the conditions shown in Tables 2 to 4 to produce steel sheets.

Some of the steel sheets were not subjected to the treatment in the first coating step (metal coating step) and/or the treatment in the coating step (second coating step).

In Nos. 107 to 110, 112 to 115, 117 to 120, 122 to 125, and 127 to 142, the treatment in the reheating and holding step was performed after the second coating step to produce steel sheets.

In the second coating step, some of the hot-rolled steel sheets (pickled) or the cold-rolled steel sheets were subjected to hot-dip galvanizing treatment or galvannealing treatment to produce hot-dip galvanized steel sheets (hereinafter also referred to as GI) or hot-dip galvannealed steel sheets (hereinafter also referred to as GA).

Some of the hot-rolled steel sheets (pickled) or the cold-rolled steel sheets were subjected to electrogalvanizing treatment (bath temperature: room temperature) to produce hot-dip electrogalvanized steel sheets (hereinafter also referred to as EG). Some of the hot-rolled steel sheets (pickled) or the cold-rolled steel sheets were subjected to hot-dip aluminum coating treatment (bath temperature: 680° C.) to produce hot-dip aluminum coated steel sheets (hereinafter also referred to as Al).

In Tables 2 to 4, the type in the second coating step is also indicated as "GI", "GA", "EG", or "Al". Those not subjected to the treatment in the second coating step are indicated as "CR".

The galvanizing bath temperature was 460° C. in the production of GI and GA.

The galvanizing coating weight ranged from 45 to 75 $g/m^2$ per side (coating on both sides) to produce GI and 40 to 65 $g/m^2$ per side (coating on both sides) to produce GA.

The composition of the galvanized layer of the final steel sheet in GI contained Fe: 0.1% to 1.0% by mass and Al: 0.20% to 0.33% by mass, the remainder being Zn and incidental impurities. In GA, Fe: 7.0% to 12.0% by mass and Al: 0.10% to 0.23% by mass were contained, the remainder being Zn and incidental impurities.

A hot-dip galvanized layer, a hot-dip galvannealed layer, an electrogalvanized layer, and another metal coated layer (corresponding to a hot-dip aluminum coated layer in Examples) were formed on both surfaces of the base steel sheet.

In the steel sheet thus produced, the steel microstructure at a quarter thickness position (base steel sheet) was identified in the manner described above. Tables 2 to 4 show the measurement results. In Tables 2 to 4, F denotes ferrite, M denotes martensite, RA denotes retained austenite, B denotes bainite, TM denotes tempered martensite, P denotes pearlite, θ denotes carbide, F' denotes unrecrystallized ferrite, and εM denotes ε-martensite.

For Nos. 107 to 146 in Table 4, the steel microstructure in the surface soft layer was identified in the manner described above.

The underlined portion in the table indicates outside the appropriate range of the present invention.

A tensile test, a hole expansion test, a V-bending test, a V-bending+orthogonal VDA bending test, and an axial crushing test were performed in the manner described below. Tensile strength (TS), yield stress (YS), total elongation (El), limiting hole expansion ratio (λ), R/t in the V-bending test, the stroke at the maximum load (SFmax) measured in the V-bending+orthogonal VDA bending test, and the presence or absence of fracture (appearance crack) in the axial crushing test were evaluated in accordance with the following criteria.

TS

Good (pass): 590 MPa or more

Poor (fail): less than 590 MPa

YS

Good (pass):

(A) For 590 MPa≤TS<780 MPa, 350 MPa≤YS (B) For 780 MPa≤TS<980 MPa, 400 MPa≤YS (C) For 980 MPa≤TS<1180 MPa, 550 MPa≤YS (D) For 1180 MPa≤TS<1320 MPa, 750 MPa≤YS (E) For 1320 MPa≤TS<1470 MPa, 900 MPa≤YS (F) For 1470 MPa≤TS, 1050 MPa≤YS

Poor (fail):

For 590 MPa≤TS<780 MPa, 350 MPa>YS

For 780 MPa≤TS<980 MPa, 400 MPa>YS

For 980 MPa≤TS<1180 MPa, 550 MPa>YS

For 1180 MPa≤TS<1320 MPa, 750 MPa>YS

For 1320 MPa≤TS<1470 MPa, 900 MPa>YS

For 1470 MPa≤TS, 1050 MPa>YS

El

Good (pass):

(A) For 590 MPa≤TS<780 MPa, 24.0%≤El (B) For 780 MPa≤TS<980 MPa, 18.0%≤El (C) For 980 MPa≤TS<1180 MPa, 11.0%≤El (D) For 1180 MPa≤TS<1320 MPa, 8.0%≤El (E) For 1320 MPa≤TS<1470 MPa, 7.5%≤El (F) For 1470 MPa≤TS, 7.0%≤El

Poor (fail):

For 590 MPa≤TS<780 MPa, 24.0%>El

For 780 MPa≤TS<980 MPa, 18.0%>El

For 980 MPa≤TS<1180 MPa, 11.0%>El

For 1180 MPa≤TS<1320 MPa, 8.0%>El

For 1320 MPa≤TS<1470 MPa, 7.5%>El

For 1470 MPa≤TS, 7.0%>El

λ

Good (pass): 20% or more

Poor (fail): less than 20%

R/t

Good (pass):

(A) For 590 MPa≤TS<780 MPa, 1.0≥R/t (B) For 780 MPa≤TS<980 MPa, 2.0≥R/t (C) For 980 MPa≤TS<1180 MPa, 2.5≥R/t (D) For 1180 MPa≤TS<1320 MPa, 3.0≥R/t (E) For 1320 MPa≤TS<1470 MPa, 3.5≥R/t (F) For 1470 MPa≤TS, 4.0≥R/t

Poor (fail):

For 590 MPa≤TS<780 MPa, 1.0<R/t

For 780 MPa≤TS<980 MPa, 2.0<R/t

For 980 MPa≤TS<1180 MPa, 2.5<R/t

For 1180 MPa≤TS<1320 MPa, 3.0<R/t

For 1320 MPa≤TS<1470 MPa, 3.5<R/t

For 1470 MPa≤TS, 4.0<R/t

SFmax

Good (pass)

(A) For 590 MPa≤TS<780 MPa, 29.0 mm≤SFmax (B) For 780 MPa≤TS<980 MPa, 27.5 mm≤SFmax (C) For 980 MPa≤TS<1180 MPa, 27.0 mm≤SFmax (D) For 1180 MPa≤TS<1320 MPa, 26.0 mm≤SFmax (E) For 1320 MPa≤TS<1470 MPa, 24.5 mm≤SFmax (F) For 1470 MPa≤TS, 24.0 mm≤SFmax Poor (fail)

For 590 MPa≤TS<780 MPa, 29.0 mm>SFmax

For 780 MPa≤TS<980 MPa, 27.5 mm>SFmax

For 980 MPa≤TS<1180 MPa, 27.0 mm>SFmax

For 1180 MPa≤TS<1320 MPa, 26.0 mm>SFmax

For 1320 MPa≤TS<1470 MPa, 24.5 mm>SFmax

For 1470 MPa≤TS, 24.0 mm>SFmax

Presence or Absence of Axial Crushing Fracture (Appearance Crack)

Excellent (pass): No appearance crack was observed in the sample after the axial crushing test.

Good (pass): No more than one appearance crack was observed in the sample after the axial crushing test.

Poor (fail): Two or more appearance cracks were observed in the sample after the axial crushing test.

(1) Tensile Test

The tensile test was performed in accordance with JIS Z 2241. A JIS No. 5 test specimen was taken from the steel sheet such that the longitudinal direction was perpendicular to the rolling direction of the base steel sheet. TS, YS, and El of the test specimen were measured at a crosshead speed of 10 mm/min in the tensile test. Tables 2 to 4 shows the results.

(2) Hole Expansion Test

The hole expansion test was performed in accordance with JIS Z 2256. A 100 mm×100 mm test specimen was taken from the steel sheet by shearing. A hole with a diameter of 10 mm was punched in the test specimen with a clearance of 12.5%. Using a die with an inner diameter of 75 mm, a blank holding force of 9 ton (88.26 kN) was then applied to the periphery of the hole, a conical punch with a vertex angle of 60 degrees was pushed into the hole in this state, and the hole diameter of the test specimen at the crack initiation limit (in crack initiation) was measured. The limiting hole expansion ratio A (%) was determined using the following formula. A is a measure for evaluating stretch-flangeability. The results are also shown in Tables 2 to 4.

$$\lambda(\%) = \{(D_f - D_0)/D_0\} \times 100$$

wherein $D_f$: Diameter (mm) of hole of test specimen in crack initiation.

$D_0$: Hole diameter (mm) of initial test specimen (3) V-Bending Test

The V (90 degrees) bending test is performed in accordance with JIS Z 2248.

A 100 mm×35 mm test specimen was taken from the steel sheet by shearing and end face grinding. The sides of 100 mm are parallel to the width (C) direction.

Bending radius R: Change in 0.5 mm interval

Test method: die support, punch pressing

Forming load: 10 ton

Test speed: 30 mm/min

Holding time: 5 s

Bending direction: direction (C) perpendicular to rolling direction

The evaluation was performed three times, and R/t was calculated by dividing the minimum bending radius (critical bending radius) R with no crack by the sheet thickness t. A crack with a length of 200 μm or more was determined as a crack using a stereomicroscope manufactured by Leica at a magnification of 25 times. R/t is a measure for evaluating bendability of press formability. The results are also shown in Tables 2 to 4.

A 90-degree V-bending test was performed in which R/t obtained by dividing the critical bending radius R by the sheet thickness t was 4.5 or more and 5.0 or less. As shown in FIG. 1, SEM images of a bending cross section were taken at a magnification of 1500 times in five visual fields. A reference line was drawn at the maximum height position of a surface raised portion and at the maximum depth position of a recessed portion of a microcrack portion in the range of 83 μm in the horizontal direction of the photograph, and the shortest distance therebetween was determined. The shortest distances on the SEM images in the five visual fields were averaged. The average value of the shortest distances thus determined was evaluated as the surface roughness depth.

(4) V-Bending+Orthogonal VDA Bending Test

The V-bending+orthogonal VDA bending test is performed as described below.

Figure 2:
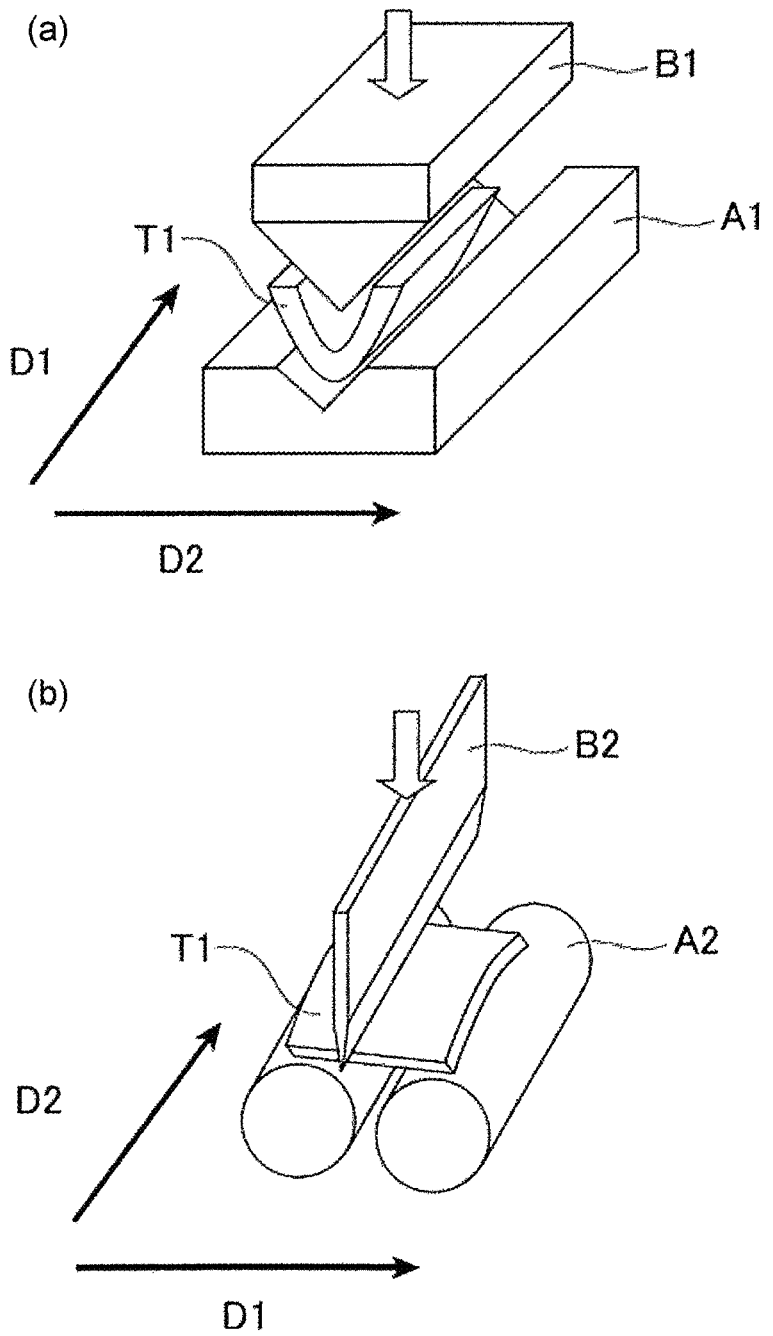
FIG. 2(*a*) is an explanatory view of V-bending (primary bending) in a V-bending+orthogonal VDA bending test in Examples.

A 60 mm×65 mm test specimen was taken from the steel sheet by shearing and end face grinding. The sides of 60 mm are parallel to the rolling (L) direction. The steel sheet was subjected to 90-degree bending (primary bending) at a curvature radius/thickness ratio of 4.2 in the rolling (L) direction with respect to an axis extending in the width (C) direction to prepare a test specimen. In the 90-degree bending (primary bending), as illustrated in FIG. 2(*a*), a punch B1 was pressed against a steel sheet on a die A1 with a V-groove to prepare a test specimen T1. Next, as illustrated in FIG. 2(*b*), the test specimen T1 on support rolls A2 was subjected to orthogonal bending (secondary bending) by pressing a punch B2 against the test specimen T1 in the direction perpendicular to the rolling direction. In FIGS. 2(*a*) and 2(*b*), D1 denotes the width (C) direction, and D2 denotes the rolling (L) direction.

The V-bending conditions in the V-bending+orthogonal VDA bending test are as follows:

Test method: die support, punch pressing

Forming load: 10 ton

Test speed: 30 mm/min

Holding time: 5 s

Bending direction: rolling (L) direction

The VDA-bending conditions in the V-bending+orthogonal VDA bending test are as follows:

Test method: roller support, punch pressing

Roller diameter: φ30 mm

Punch tip R: 0.4 mm

Distance between rolls: (sheet thickness×2)+0.5 mm

Stroke speed: 20 mm/min

Test specimen size: 60 mm×60 mm

Bending direction: direction (C) perpendicular to rolling direction

The stroke at the maximum load is determined in a stroke-load curve of the VDA bending. The average value of the stroke at the maximum load when the V-bending+orthogonal VDA bending test was performed three times was defined as SFmax (mm). SFmax is a measure for evaluating fracture resistance characteristics (fracture resistance characteristics of a bending ridge line portion in the axial crushing test) in case of a collision. The results are also shown in Tables 2 to 4.

(5) Axial Crushing Test

Figure 3:
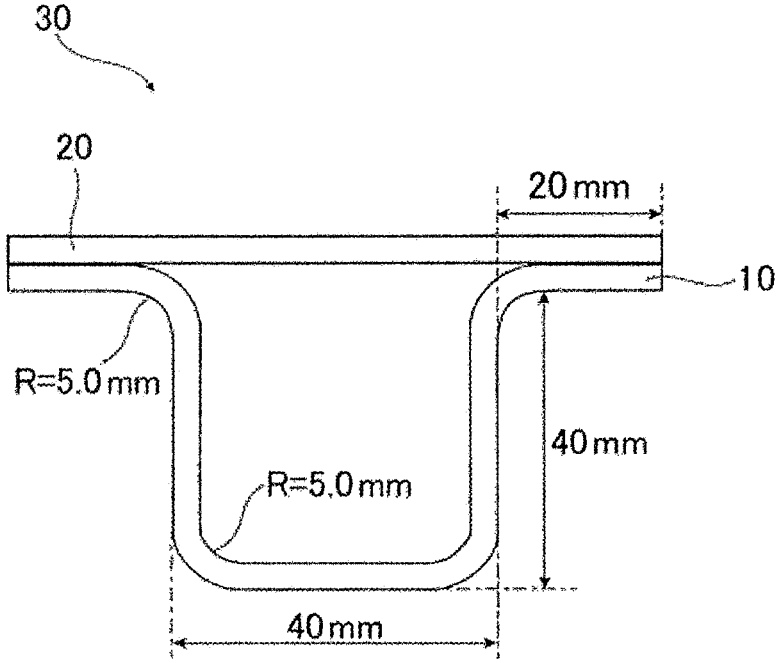
Figure 1:
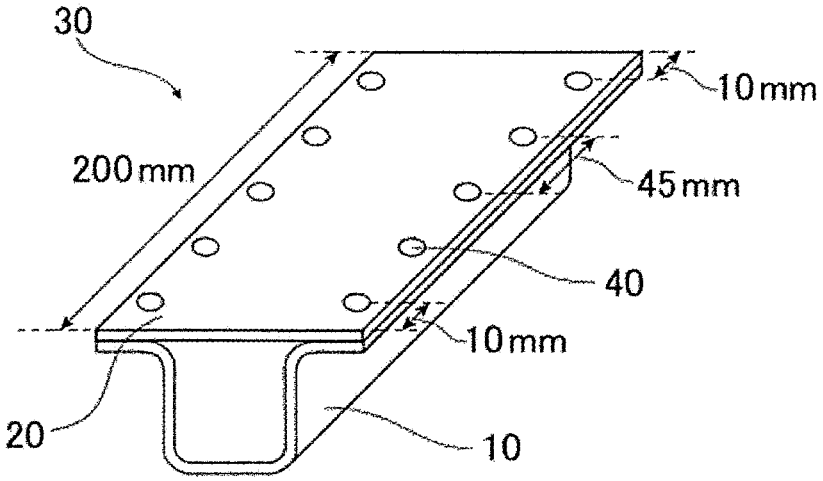
Figures 2, 3:
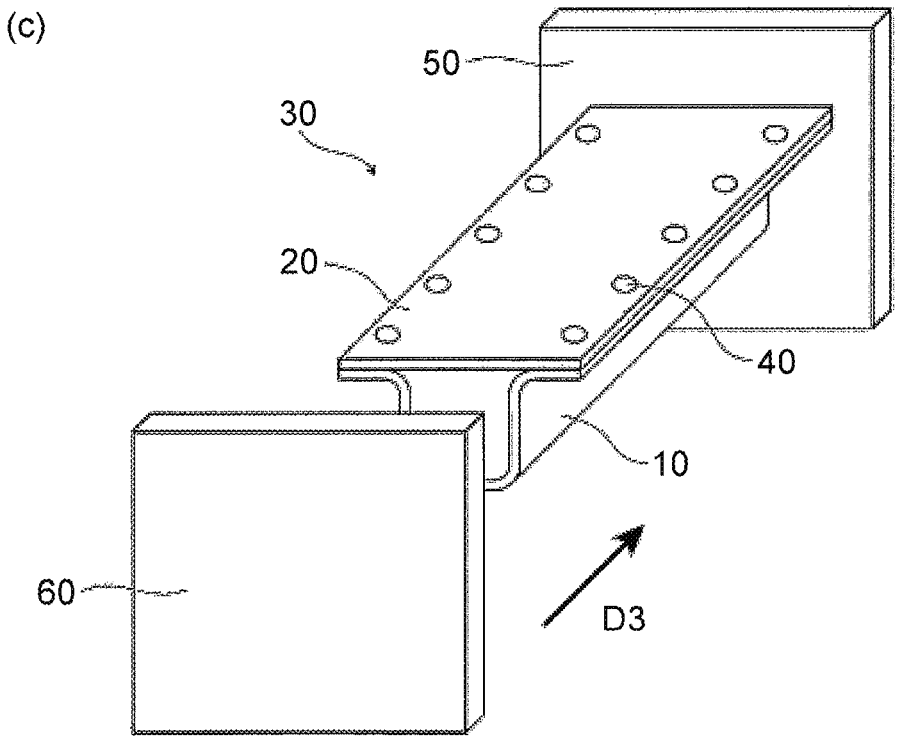

A 160 mm×200 mm test specimen was taken from the steel sheet by shearing. The sides of 160 mm are parallel to the rolling (L) direction. A hat-shaped member 10 with a depth of 40 mm illustrated in FIGS. 3-1(*a*) and 3-1(*b*) was produced by forming (bending) with a die having a punch corner radius of 5.0 mm and a die corner radius of 5.0 mm. The steel sheet used as the material of the hat-shaped member was separately cut into a size of 80 mm×200 mm. Next, the cut-out steel sheet 20 and the hat-shaped member 10 were spot-welded together to produce a test member 30 as illustrated in FIGS. 3-1(*a*) and 3-1(*b*). FIG. 3-1(*a*) is a front view of the test member 30 produced by spot-welding the hat-shaped member 10 and the steel sheet 20. FIG. 3-1(*b*) is a perspective view of the test member 30. As illustrated in FIG. 3-1(*b*), spot welds 40 were positioned such that the distance between an end portion of the steel sheet and a weld was 10 mm and the distance between the welds was 45 mm. Next, as illustrated in FIG. 3-2(*c*), the test member 30 was joined to a base plate 50 by TIG welding to produce an axial crushing test sample. Next, the axial crushing test sample was collided with an impactor 60 at a constant collision speed of 10 mm/min to crush the axial crushing test sample by 70 mm. As illustrated in FIG. 3-2(*c*), the crushing direction D3 was a direction parallel to the longitudinal direction of the test member 30. The results are also shown in Tables 2 to 4.

The V-bending test, the V-bending+orthogonal VDA bending test, and the axial crushing test of a steel sheet with a thickness of more than 1.2 mm were all performed on a steel sheet with a thickness of 1.2 mm in consideration of the influence of the sheet thickness. A steel sheet with a thickness of more than 1.2 mm was ground on one side to have a thickness of 1.2 mm.

The bendability of the surface of the steel sheet may be affected by grinding. Thus, the grinding surface was the inner side of bending (valley side) in the V-bending test. In the V-bending+orthogonal VDA bending test, the grinding surface was the outer side of bending (peak side) in the V-bending test and the inner side of bending (valley side) in the subsequent VDA bending test.

<Nanohardness Measurement>

To achieve high bendability during press forming and good bending fracture characteristics in case of a collision, when the nanohardness is measured at 300 points or more in a 50 μm×50 μm region on a sheet surface at a quarter depth position in the thickness direction of a surface soft layer from the surface of a base steel sheet, the ratio of the nanohardness of 7.0 GPa or more on the sheet surface at the quarter depth position in the thickness direction of the surface soft layer from the surface of the base steel sheet is 0.10 or less with respect to the total number of measurements. When the ratio of the nanohardness of 7.0 GPa or more is 0.10 or less, it means a low ratio of a hard microstructure (martensite or the like), an inclusion, or the like, and this can further suppress the formation and connection of voids and the propagation of a crack of the hard microstructure (martensite and the like), inclusion, or the like during press forming and in case of a collision, thus resulting in high R/t and SFmax.

Coating peeling was followed by mechanical polishing to (the quarter depth position in the thickness direction of the surface soft layer from the surface of the base steel sheet −5 μm), by buffing with diamond and alumina to the quarter depth position in the thickness direction of the surface soft layer from the surface of the base steel sheet, and then by colloidal silica polishing. A total of 512 nanohardness points were measured with Hysitron tribo-950 and a Berkovich diamond indenter under the following conditions.

Load: 500 μN

Measurement region: 50 μm×50 μm

Dot-to-dot distance: 2 μm

Next, mechanical polishing, buffing with diamond and alumina, and colloidal silica polishing were performed to the half depth position in the thickness direction of the surface soft layer. A total of 512 nanohardness points were measured with Hysitron tribo-950 and a Berkovich diamond indenter under the following conditions.

Load: 500 μN

Measurement region: 50 μm×50 μm

Dot-to-dot distance: 2 μm

Measurement is performed on the surface soft layer as described below. After smoothing a thickness cross section (L cross section) parallel to the rolling direction of the steel sheet by wet grinding, measurement was performed in accordance with JIS Z 2244-1 (2020) using a Vickers hardness tester at a load of 10 gf from a 1-μm position to a 100-μm position in the thickness direction from the surface of the steel sheet at intervals of 1 μm. Measurement was then performed at intervals of 20 μm to the central portion in the thickness direction. A region with hardness corresponding to 85% or less of the hardness at the quarter thickness position is defined as a soft layer (surface soft layer), and the thickness of the region in the thickness direction is defined as the thickness of the soft layer.

TABLE 1

| Type of steel | Chemical composition (% by mass) C | Si | Mn | P | S | Al | N | Others | Ceq (%) (*1) | Calculated transformation point (° C.) Ac1 | Note |
|---|---|---|---|---|---|---|---|---|---|---|---|
| A | 0.093 | 0.45 | 1.70 | 0.020 | 0.0030 | 0.045 | 0.0033 | — | 0.40 | 734 | Conforming steel |
| B | 0.093 | 1.50 | 1.45 | 0.020 | 0.0024 | 0.052 | 0.0052 | — | 0.40 | 749 | Conforming steel |
| C | 0.073 | 1.00 | 2.30 | 0.015 | 0.0040 | 0.032 | 0.0042 | — | 0.50 | 744 | Conforming steel |
| D | 0.063 | 0.23 | 2.40 | 0.020 | 0.0015 | 0.050 | 0.0032 | — | 0.47 | 733 | Conforming steel |
| E | 0.113 | 1.40 | 1.93 | 0.020 | 0.0020 | 0.043 | 0.0050 | — | 0.49 | 748 | Conforming steel |
| F | 0.110 | 1.38 | 2.77 | 0.018 | 0.0020 | 0.051 | 0.0033 | Ti: 0.018, B: 0.0015 | 0.63 | 750 | Conforming steel |
| G | 0.221 | 1.45 | 2.30 | 0.015 | 0.0020 | 0.033 | 0.0049 | — | 0.66 | 746 | Conforming steel |
| H | 0.089 | 0.18 | 2.40 | 0.014 | 0.0015 | 0.037 | 0.0035 | Nb: 0.010, Ti: 0.015, B: 0.0010 | 0.50 | 732 | Conforming steel |
| I | 0.086 | 0.63 | 2.60 | 0.010 | 0.0020 | 0.039 | 0.0035 | Nb: 0.010, Mo: 0.120 | 0.58 | 739 | Conforming steel |
| J | 0.130 | 0.60 | 2.70 | 0.013 | 0.0020 | 0.046 | 0.0033 | — | 0.61 | 737 | Conforming steel |
| K | 0.143 | 1.30 | 2.15 | 0.020 | 0.0013 | 0.042 | 0.0039 | — | 0.56 | 746 | Conforming steel |
| L | 0.120 | 0.40 | 2.65 | 0.010 | 0.0008 | 0.043 | 0.0044 | Nb: 0.045, Cr: 0.510 | 0.68 | 734 | Conforming steel |
| M | 0.192 | 1.65 | 2.77 | 0.009 | 0.0007 | 0.040 | 0.0041 | Ti: 0.022, B: 0.0018 | 0.72 | 751 | Conforming steel |
| N | 0.138 | 0.35 | 1.82 | 0.010 | 0.0009 | 0.034 | 0.0049 | — | 0.46 | 731 | Conforming steel |
| O | 0.208 | 0.28 | 1.25 | 0.010 | 0.0009 | 0.041 | 0.0036 | — | 0.43 | 727 | Conforming steel |
| P | 0.191 | 0.92 | 3.18 | 0.010 | 0.0010 | 0.044 | 0.0037 | — | 0.76 | 741 | Conforming steel |
| Q | 0.600 | 1.00 | 2.75 | 0.012 | 0.0012 | 0.043 | 0.0049 | — | 1.10 | 728 | Comparative steel |
| R | 0.010 | 1.24 | 2.55 | 0.011 | 0.0015 | 0.052 | 0.0035 | — | 0.49 | 750 | Comparative steel |
| S | 0.130 | 3.50 | 2.23 | 0.012 | 0.0018 | 0.045 | 0.0037 | — | 0.65 | 779 | Comparative steel |
| T | 0.115 | 0.84 | 12.00 | 0.014 | 0.0014 | 0.036 | 0.0043 | — | 2.15 | 760 | Comparative steel |
| U | 0.078 | 0.46 | 2.60 | 0.010 | 0.0012 | 0.035 | 0.0040 | V: 0.052 | 0.53 | 737 | Conforming steel |
| V | 0.103 | 0.93 | 2.46 | 0.008 | 0.0009 | 0.035 | 0.0045 | Cu: 0.280, Ni: 0.150 | 0.56 | 742 | Conforming steel |
| W | 0.205 | 1.43 | 2.22 | 0.007 | 0.0008 | 0.050 | 0.0037 | Sb: 0.008, Sn: 0.005 | 0.63 | 746 | Conforming steel |

TABLE 1-continued

| Type of steel | Chemical composition (% by mass) C | Si | Mn | P | S | Al | N | Others | Ceq (%) (*1) | Calculated transformation point (° C.) Ac1 | Note |
|---|---|---|---|---|---|---|---|---|---|---|---|
| X | 0.102 | 0.63 | 2.70 | 0.015 | 0.0029 | 0.048 | 0.0035 | Ta: 0.003, W: 0.030, Zn: 0.0040 | 0.58 | 738 | Conforming steel |
| Y | 0.150 | 0.93 | 2.61 | 0.016 | 0.0009 | 0.042 | 0.0046 | Co: 0.0080, Zr: 0.0030 | 0.62 | 741 | Conforming steel |
| Z | 0.214 | 1.23 | 2.45 | 0.018 | 0.0078 | 0.035 | 0.0038 | Se: 0.0035, Te: 0.0040, Ge: 0.0060 | 0.67 | 743 | Conforming steel |
| AA | 0.172 | 1.22 | 3.18 | 0.016 | 0.0032 | 0.041 | 0.0046 | Ge: 0.0060, As: 0.0100 | 0.75 | 746 | Conforming steel |
| AB | 0.191 | 0.55 | 3.48 | 0.009 | 0.0017 | 0.035 | 0.0033 | Sr: 0.0050, Cs: 0.0040, Hf: 0.0040 | 0.79 | 736 | Conforming steel |
| AC | 0.195 | 0.75 | 3.02 | 0.021 | 0.0019 | 0.043 | 0.0039 | Pb: 0.0070, Bi: 0.0050 | 0.73 | 738 | Conforming steel |
| AD | 0.216 | 1.01 | 2.85 | 0.011 | 0.0015 | 0.032 | 0.0039 | Ca: 0.0035, Mg: 0.0040, REM: 0.0040 | 0.73 | 741 | Conforming steel |
| AB | 0.334 | 0.54 | 1.28 | 0.007 | 0.0010 | 0.030 | 0.0034 | Ti: 0.015, Nb: 0.015, B: 0.0020, Cu: 0.100 | 0.57 | 727 | Conforming steel |
| AF | 0.272 | 1.10 | 3.01 | 0.008 | 0.0011 | 0.031 | 0.0035 | Ti: 0.015, B: 0.0020, Sb: 0.012 | 0.82 | 741 | Conforming steel |
| AG | 0.312 | 0.38 | 3.15 | 0.009 | 0.0013 | 0.035 | 0.0038 | Ti: 0.020, Nb: 0.030, B: 0.0020 | 0.85 | 729 | Conforming steel |
| AH | 0.068 | 0.16 | 1.79 | 0.016 | 0.0012 | 0.035 | 0.0036 | Nb: 0.180, Ti: 0.180, V: 0.180, B: 0.0095 Cr: 0.970, Ni: 0.950, Mo: 0.980, Sb: 0.180, Sn: 0.170, Cu: 0.950, Ta: 0.095, W: 0.480, Mg: 0.0180, Zn: 0.0170, Co: 0.0190, Zr: 0.0950, Ca: 0.0190, Se: 0.0180, Te: 0.0185, Ge: 0.0180, As: 0.0450, Sr: 0.0190, Cs: 0.0185, Hf: 0.0190, Pb: 0.0190, Bi: 0.0180, REM: 0.0185 | 0.85 | 731 | Conforming steel |

The remainder other than these is composed of Fe and incidental impurities.
The underline indicates that it is outside the scope of the present invention.
(*1) Ceq = C + Si/24 + Mn/6 + Ni/40 + Cr/5 + Mo/4 + V/14

TABLE 2

| No. | Type of steel | Production conditions: First coating Presence or absence (Coating type) | Annealing temperature (° C.) | Annealing time (s) | Dew-point temperature (° C.) | First cooling Average cooling rate (*1) (° C./s) | First cooling Dew-point temperature (° C.) | Second cooling Average cooling rate (*2) (° C./s) | Second coating Type | Thickness (mm) |
|---|---|---|---|---|---|---|---|---|---|---|
| 1 | A | Absent | 811 | 147 | −14 | 11 | −45 | 5 | CR | 1.2 |
| 2 | A | Absent | 815 | 101 | 8 | 18 | −48 | 3 | CR | 1.2 |
| 3 | A | Present (Fe) | 812 | 132 | −14 | 14 | −44 | 4 | CR | 1.2 |
| 4 | A | Present (Fe) | 821 | 140 | 8 | 13 | −36 | 3 | CR | 1.2 |
| 5 | B | Absent | 832 | 161 | −17 | 11 | −45 | 6 | GA | 1.2 |
| 6 | B | Absent | 829 | 172 | 10 | 15 | −34 | 5 | GA | 1.2 |
| 7 | B | Present (Fe) | 825 | 149 | −17 | 19 | −46 | 3 | GA | 1.2 |
| 8 | B | Present (Fe) | 823 | 124 | 10 | 17 | −48 | 2 | GA | 1.2 |
| 9 | C | Absent | 822 | 153 | −18 | 18 | −37 | 6 | GI | 1.2 |
| 10 | C | Absent | 825 | 156 | 6 | 10 | −36 | 4 | GI | 1.2 |
| 11 | C | Present (Fe) | 820 | 130 | −18 | 14 | −47 | 3 | GI | 1.2 |
| 12 | C | Present (Fe) | 828 | 102 | 6 | 13 | −47 | 3 | GI | 1.2 |
| 13 | D | Absent | 811 | 161 | −20 | 19 | −50 | 6 | EG | 1.2 |
| 14 | D | Absent | 815 | 172 | 5 | 17 | −50 | 2 | EG | 1.2 |
| 15 | D | Present (Fe) | 810 | 165 | −20 | 18 | −46 | 6 | EG | 1.2 |
| 16 | D | Present (Fe) | 815 | 151 | 5 | 11 | −46 | 3 | EG | 1.2 |
| 17 | E | Absent | 828 | 140 | −16 | 15 | −50 | 3 | GA | 1.2 |
| 18 | E | Absent | 825 | 146 | 9 | 14 | −49 | 6 | GA | 1.2 |
| 19 | E | Present (Fe) | 820 | 157 | −16 | 16 | −37 | 5 | GA | 1.2 |
| 20 | E | Present (Fe) | 823 | 178 | 9 | 9 | −41 | 6 | GA | 1.2 |
| 21 | F | Absent | 842 | 100 | −13 | 20 | −43 | 5 | GA | 1.2 |
| 22 | F | Absent | 844 | 160 | 9 | 15 | −33 | 3 | GA | 1.2 |
| 23 | F | Present (Fe) | 848 | 108 | −13 | 9 | −46 | 1 | GA | 1.2 |

TABLE 2-continued

| | | | | | | | | | | |
|---|---|---|---|---|---|---|---|---|---|---|
| 24 | F | Present (Fe) | 850 | 129 | 9 | 10 | −45 | 5 | GA | 1.2 |
| 25 | G | Absent | 832 | 108 | −11 | 13 | −36 | 3 | CR | 1.2 |
| 26 | G | Absent | 832 | 119 | 5 | 13 | −44 | 6 | CR | 1.2 |
| 27 | G | Present (Fe) | 828 | 156 | −11 | 14 | −31 | 1 | CR | 1.2 |
| 28 | G | Present (Fe) | 830 | 130 | 5 | 12 | −47 | 6 | CR | 1.2 |
| 29 | H | Absent | 823 | 103 | −14 | 16 | −40 | 5 | GA | 1.2 |
| 30 | H | Absent | 816 | 157 | 8 | 20 | −37 | 1 | GA | 1.2 |
| 31 | H | Present (Fe) | 820 | 139 | −14 | 16 | −49 | 6 | GA | 1.2 |
| 32 | H | Present (Fe) | 827 | 160 | 8 | 14 | −41 | 3 | GA | 1.2 |
| 33 | I | Absent | 805 | 180 | −15 | 14 | −42 | 2 | GA | 1.2 |
| 34 | I | Absent | 803 | 103 | 10 | 19 | −31 | 3 | GA | 1.2 |
| 35 | I | Present (Fe) | 800 | 168 | −15 | 15 | −43 | 6 | GA | 1.2 |
| 36 | I | Present (Fe) | 802 | 126 | 10 | 14 | −30 | 1 | GA | 1.2 |
| 37 | J | Absent | 805 | 155 | −15 | 9 | −38 | 1 | GI | 1.2 |
| 38 | J | Absent | 803 | 162 | 9 | 9 | −42 | 1 | GI | 1.2 |
| 39 | J | Present (Fe) | 800 | 128 | −15 | 15 | −45 | 5 | GI | 1.2 |
| 40 | J | Present (Fe) | 802 | 173 | 9 | 12 | −43 | 6 | GI | 1.2 |
| 41 | K | Absent | 835 | 119 | −19 | 19 | −44 | 6 | EG | 1.2 |
| 42 | K | Absent | 838 | 111 | 3 | 12 | −41 | 3 | EG | 1.2 |
| 43 | K | Present (Fe) | 832 | 135 | −19 | 10 | −31 | 6 | EG | 1.2 |
| 44 | K | Present (Fe) | 829 | 116 | 3 | 20 | −31 | 4 | EG | 1.2 |
| 45 | L | Absent | 832 | 175 | −15 | 14 | −39 | 2 | GA | 1.2 |
| 46 | L | Absent | 835 | 125 | −5 | 11 | −47 | 2 | GA | 1.2 |
| 47 | L | Absent | 831 | 102 | 5 | 15 | −31 | 3 | GA | 1.2 |
| 48 | L | Present (Fe) | 836 | 164 | −15 | 13 | −37 | 2 | GA | 1.2 |
| 49 | L | Present (Fe) | 828 | 131 | 5 | 10 | −31 | 2 | GA | 1.2 |
| 50 | L | Present (Ni) | 832 | 124 | 5 | 12 | −35 | 1 | GA | 1.2 |

| | Microstructure at quarter thickness position | | | | Surface layer | | Surface nanohardness Hn | | | |
|---|---|---|---|---|---|---|---|---|---|---|
| No. | M (%) | RA (%) | TM (%) | Remainder microstructure | Soft layer thickness (μm) | Metal coating weight (*3) (g/m$^2$) | Ratio of Hn of 7.0 GPa or more (*4) | Standard deviation of Hn at quarter position (*5) (GPa) | Standard deviation of Hn at half position (*6) (GPa) | Surface roughness (*7) (μm) |
| 1 | 7.6 | 0.9 | 3.0 | F, B, θ | 21 | — | 0.03 | 0.7 | 1.3 | 7.4 |
| 2 | 8.2 | 1.2 | 3.2 | F, B, θ | 59 | — | 0.02 | 0.3 | 0.9 | 8.2 |
| 3 | 7.9 | 1.5 | 2.8 | F, B, θ | 28 | 10.0 | 0.03 | 0.6 | 1.1 | 2.3 |
| 4 | 7.6 | 1.1 | 3.5 | F, B, θ | 68 | 10.0 | 0.01 | 0.2 | 0.7 | 2.1 |
| 5 | 8.2 | 2.2 | 1.2 | F, B, θ, P | 23 | — | 0.03 | 0.6 | 1.2 | 6.1 |
| 6 | 9.5 | 2.1 | 1.5 | F, B, θ, P | 64 | — | 0.01 | 0.3 | 0.8 | 7.3 |
| 7 | 8.7 | 2.5 | 1.2 | F, B, θ, P | 30 | 10.0 | 0.02 | 0.5 | 1.0 | 1.1 |
| 8 | 9.3 | 2.6 | 1.0 | F, B, θ | 71 | 10.0 | 0.01 | 0.2 | 0.6 | 0.9 |
| 9 | 28.0 | 0.8 | 16.1 | F, B, θ | 15 | — | 0.05 | 1.1 | 1.5 | 6.4 |
| 10 | 28.7 | 0.6 | 14.6 | F, B, θ | 44 | — | 0.03 | 0.8 | 1.1 | 8.1 |
| 11 | 29.1 | 0.7 | 15.7 | F, B, θ | 18 | 13.0 | 0.04 | 1.0 | 1.3 | 2.3 |
| 12 | 28.5 | 0.9 | 14.9 | F, B, θ | 50 | 13.0 | 0.02 | 0.6 | 0.9 | 2.6 |
| 13 | 26.0 | 2.3 | 2.1 | F, B, θ | 12 | — | 0.04 | 1.0 | 1.6 | 7.9 |
| 14 | 25.7 | 2.4 | 1.4 | F, B, θ | 42 | — | 0.03 | 0.7 | 1.2 | 8.9 |
| 15 | 26.1 | 2.1 | 1.6 | F, B, θ | 16 | 16.0 | 0.04 | 0.9 | 1.3 | 1.8 |
| 16 | 25.5 | 2.2 | 2.2 | F, B, θ | 50 | 16.0 | 0.02 | 0.6 | 0.9 | 1.6 |
| 17 | 19.5 | 14.3 | 1.1 | F, B, θ | 12 | — | 0.04 | 1.1 | 1.4 | 4.8 |
| 18 | 18.9 | 13.5 | 1.2 | F, B, θ | 42 | — | 0.03 | 0.8 | 1.1 | 5.6 |
| 19 | 20.2 | 14.2 | 0.9 | F, B, θ | 16 | 16.0 | 0.04 | 0.9 | 1.2 | 0.4 |
| 20 | 19.1 | 13.3 | 1.0 | F, B, θ | 50 | 16.0 | 0.02 | 0.5 | 0.8 | 0.5 |
| 21 | 5.1 | 9.7 | 50.3 | F, B, θ | 17 | — | 0.05 | 1.2 | 1.5 | 7.1 |
| 22 | 5.5 | 10.3 | 48.6 | F, B, θ | 78 | — | 0.03 | 0.8 | 1.2 | 8.1 |
| 23 | 6.2 | 10.6 | 49.2 | F, B, θ | 22 | 10.0 | 0.04 | 1.0 | 1.3 | 1.4 |
| 24 | 5.8 | 9.9 | 50.7 | F, B, θ | 89 | 10.0 | 0.02 | 0.6 | 0.9 | 2.3 |
| 25 | 6.2 | 12.2 | 15.8 | F, B, θ | 18 | — | 0.06 | 1.6 | 2.0 | 7.2 |
| 26 | 5.5 | 11.5 | 14.6 | F, B, θ | 38 | — | 0.04 | 1.2 | 1.6 | 8.4 |
| 27 | 6.3 | 12.6 | 17.1 | F, B, θ | 23 | 13.0 | 0.05 | 1.4 | 1.8 | 2.5 |
| 28 | 5.8 | 12.9 | 16.5 | F, B, θ | 44 | 13.0 | 0.02 | 0.7 | 1.1 | 2.2 |
| 29 | 41.1 | 0.5 | 8.2 | F, θ | 16 | — | 0.05 | 1.5 | 1.8 | 5.3 |
| 30 | 40.2 | 0.8 | 9.1 | F, θ | 34 | — | 0.03 | 1.1 | 1.4 | 6.2 |
| 31 | 40.1 | 0.6 | 8.5 | F, θ | 20 | 10.0 | 0.04 | 1.4 | 1.6 | 0.6 |
| 32 | 40.5 | 0.7 | 8.9 | F, θ | 42 | 10.0 | 0.01 | 0.6 | 0.9 | 0.8 |
| 33 | 43.1 | 0.4 | 3.2 | F, B, θ | 18 | — | 0.04 | 1.4 | 1.6 | 3.5 |
| 34 | 43.2 | 0.5 | 2.8 | F, B, θ | 33 | — | 0.02 | 0.9 | 1.2 | 4.2 |
| 35 | 44.1 | 0.3 | 2.7 | F, B, θ | 22 | 10.0 | 0.03 | 1.2 | 1.4 | 0.5 |
| 36 | 43.5 | 0.6 | 2.9 | F, B, θ | 41 | 10.0 | 0.01 | 0.5 | 0.8 | 0.4 |
| 37 | 2.1 | 3.2 | 73.2 | F, B, θ | 20 | — | 0.05 | 1.4 | 1.7 | 5.1 |
| 38 | 2.5 | 3.0 | 74.3 | F, B, θ | 39 | — | 0.02 | 0.9 | 1.2 | 6.2 |
| 39 | 2.6 | 2.9 | 74.8 | F, B, θ | 22 | 13.0 | 0.03 | 1.3 | 1.4 | 1.3 |
| 40 | 2.2 | 3.2 | 73.6 | F, B, θ | 51 | 13.0 | 0.01 | 0.5 | 0.8 | 1.4 |
| 41 | 3.4 | 0.7 | 48.2 | F, θ | 15 | — | 0.07 | 1.5 | 1.9 | 7.5 |

TABLE 2-continued

| | | | | | | | | | | |
|---|---|---|---|---|---|---|---|---|---|---|
| 42 | 3.0 | 6.0 | 49.3 | F, θ | 42 | — | 0.04 | 1.1 | 1.4 | 7.9 |
| 43 | 3.5 | 0.9 | 48.5 | F, θ | 19 | 16.0 | 0.05 | 1.4 | 1.6 | 2.4 |
| 44 | 3.1 | 1.0 | 48.6 | F, θ | 63 | 16.0 | 0.03 | 0.8 | 1.0 | 2.6 |
| 45 | 3.8 | 1.1 | 61.2 | B, θ | 18 | — | 0.08 | 1.5 | 1.9 | 3.7 |
| 46 | 4.1 | 0.8 | 60.4 | B, θ | 38 | — | 0.05 | 1.1 | 1.4 | 4.1 |
| 47 | 3.6 | 0.6 | 59.7 | B, θ | 72 | — | 0.02 | 0.9 | 1.0 | 4.8 |
| 48 | 3.9 | 1.1 | 60.5 | B, θ | 22 | 10.0 | 0.07 | 1.4 | 1.7 | 0.2 |
| 49 | 4.0 | 0.3 | 60.1 | B, θ | 89 | 10.0 | 0.01 | 0.7 | 0.8 | 0.3 |
| 50 | 3.7 | 0.9 | 59.6 | B, θ | 82 | 10.0 | 0.02 | 0.8 | 0.9 | 0.3 |

| | Evaluation | | | | | | | |
|---|---|---|---|---|---|---|---|---|
| No. | YS (MPa) | TS (MPa) | EI (%) | λ (%) | R/t | V-bending + VDA bending SFmax (mm) | Axial crushing characteristics | Note |
| 1 | 486 | 600 | 24.5 | 62 | 0.00 | 29.3 | Excellent | Inventive example |
| 2 | 428 | 609 | 25.5 | 62 | 0.00 | 30.2 | Excellent | Inventive example |
| 3 | 406 | 608 | 24.9 | 58 | 0.00 | 29.8 | Excellent | Inventive example |
| 4 | 474 | 602 | 25.6 | 62 | 0.00 | 30.6 | Excellent | Inventive example |
| 5 | 386 | 639 | 31.1 | 61 | 0.00 | 29.7 | Excellent | Inventive example |
| 6 | 385 | 616 | 30.4 | 71 | 0.00 | 30.5 | Excellent | Inventive example |
| 7 | 370 | 613 | 26.5 | 69 | 0.00 | 30.1 | Excellent | Inventive example |
| 8 | 382 | 617 | 29.2 | 66 | 0.00 | 31.0 | Excellent | Inventive example |
| 9 | 500 | 832 | 22.8 | 32 | 1.25 | 27.8 | Good | Inventive example |
| 10 | 515 | 827 | 23.2 | 33 | 0.42 | 28.3 | Excellent | Inventive example |
| 11 | 512 | 839 | 23.0 | 31 | 0.83 | 28.1 | Excellent | Inventive example |
| 12 | 503 | 827 | 22.5 | 35 | 0.00 | 29.1 | Excellent | Inventive example |
| 13 | 510 | 803 | 20.8 | 37 | 1.25 | 27.9 | Good | Inventive example |
| 14 | 530 | 807 | 21.2 | 38 | 0.42 | 28.1 | Excellent | Inventive example |
| 15 | 528 | 829 | 20.0 | 34 | 0.83 | 28.3 | Excellent | Inventive example |
| 16 | 503 | 827 | 20.1 | 35 | 0.00 | 29.0 | Excellent | Inventive example |
| 17 | 461 | 820 | 26.6 | 25 | 1.25 | 27.8 | Good | Inventive example |
| 18 | 450 | 805 | 27.0 | 30 | 0.42 | 28.4 | Excellent | Inventive example |
| 19 | 436 | 805 | 27.4 | 31 | 0.83 | 28.9 | Excellent | Inventive example |
| 20 | 446 | 827 | 27.5 | 26 | 0.00 | 29.3 | Excellent | Inventive example |
| 21 | 872 | 1041 | 16.5 | 65 | 1.25 | 27.8 | Good | Inventive example |
| 22 | 868 | 1040 | 15.7 | 68 | 0.00 | 30.2 | Excellent | Inventive example |
| 23 | 864 | 1038 | 15.6 | 68 | 0.42 | 28.1 | Excellent | Inventive example |
| 24 | 872 | 1049 | 16.4 | 67 | 0.00 | 30.7 | Excellent | Inventive example |
| 25 | 581 | 1050 | 19.6 | 29 | 1.25 | 27.6 | Good | Inventive example |
| 26 | 633 | 1032 | 21.4 | 27 | 0.42 | 28.9 | Excellent | Inventive example |
| 27 | 626 | 1045 | 20.8 | 27 | 0.83 | 28.1 | Excellent | Inventive example |
| 28 | 628 | 1037 | 21.5 | 23 | 0.00 | 29.5 | Excellent | Inventive example |
| 29 | 633 | 1047 | 21.2 | 24 | 1.25 | 27.8 | Good | Inventive example |
| 30 | 593 | 1040 | 20.7 | 25 | 0.42 | 29.1 | Excellent | Inventive example |
| 31 | 612 | 1033 | 20.6 | 27 | 0.83 | 28.5 | Excellent | Inventive example |
| 32 | 605 | 1036 | 21.5 | 25 | 0.00 | 29.7 | Excellent | Inventive example |
| 33 | 626 | 1032 | 14.3 | 30 | 0.83 | 27.3 | Good | Inventive example |
| 34 | 628 | 1047 | 14.8 | 21 | 0.00 | 29.5 | Excellent | Inventive example |
| 35 | 639 | 1039 | 15.1 | 21 | 0.42 | 28.6 | Excellent | Inventive example |
| 36 | 628 | 1031 | 14.4 | 27 | 0.00 | 29.9 | Excellent | Inventive example |
| 37 | 631 | 1044 | 20.5 | 25 | 1.25 | 27.1 | Good | Inventive example |
| 38 | 600 | 1047 | 20.6 | 29 | 0.42 | 28.5 | Excellent | Inventive example |
| 39 | 633 | 1030 | 20.6 | 30 | 0.83 | 27.9 | Excellent | Inventive example |
| 40 | 584 | 1044 | 20.1 | 25 | 0.00 | 29.1 | Excellent | Inventive example |
| 41 | 881 | 1245 | 10.6 | 48 | 1.67 | 26.1 | Good | Inventive example |
| 42 | 885 | 1233 | 11.1 | 44 | 0.83 | 27.6 | Excellent | Inventive example |
| 43 | 893 | 1231 | 12.6 | 42 | 1.25 | 27.0 | Excellent | Inventive example |
| 44 | 889 | 1242 | 11.2 | 39 | 0.00 | 28.0 | Excellent | Inventive example |
| 45 | 834 | 1238 | 10.0 | 31 | 1.67 | 26.3 | Good | Inventive example |
| 46 | 837 | 1204 | 10.6 | 50 | 0.42 | 27.1 | Excellent | Inventive example |
| 47 | 823 | 1200 | 10.7 | 39 | 0.00 | 28.9 | Excellent | Inventive example |
| 48 | 852 | 1226 | 11.6 | 40 | 1.25 | 26.8 | Excellent | Inventive example |
| 49 | 849 | 1206 | 10.9 | 34 | 0.00 | 29.2 | Excellent | Inventive example |
| 50 | 842 | 1234 | 10.5 | 36 | 0.00 | 29.0 | Excellent | Inventive example |

(*1) Average cooling rate in temperature range of Ac1 point to 450° C. (° C./s)

(*2) Average cooling rate in temperature range of less than 450° C. to 300° C. (° C./s)

(*3) Metal coating weight ($g/m^2$): first coating weight ($g/m^2$)

(*4) Ratio of number of measurements of nanohardness of 7.0 GPa or more on sheet surface at quarter depth position in thickness direction of surface soft layer from surface of base steel sheet to total number of measurements (*5) Standard deviation σ of nanohardness of sheet surface at quarter depth position in thickness direction of surface soft layer from surface of base steel sheet (GPa)

(*6) Standard deviation σ of nanohardness of sheet surface at half depth position in thickness direction of surface soft layer from surface of base steel sheet (GPa)

(*7) Surface roughness depth of test specimen after 90-degree V-bending in which R/t obtained by dividing critical bending radius R by thickness t is 4.5 or more and 5.0 or less (μm)

TABLE 3

| | | Production conditions | | | | | | | | |
|---|---|---|---|---|---|---|---|---|---|---|
| | | | | | | first cooling | | second cooling | | |
| | | First coating | Annealing | | | Average | | Average | | |
| No. | Type of steel | Presence or absence (Coating type) | Annealing temperature (° C.) | Annealing time (s) | Dew-point temperature (° C.) | cooling rate (*1) (° C./s) | Dew-point temperature (° C.) | cooling rate (*2) (° C./s) | second coating Type | Thickness (mm) |
| 51 | M | Absent | 800 | 171 | −15 | 17 | −38 | 3 | GA | 1.2 |
| 52 | M | Absent | 802 | 158 | 10 | 15 | −43 | 2 | GA | 1.2 |
| 53 | M | Present (Fe) | 803 | 122 | −15 | 20 | −46 | 5 | GA | 1.2 |
| 54 | M | Present (Fe) | 800 | 124 | 10 | 11 | −47 | 1 | GA | 1.2 |
| 55 | N | Absent | 849 | 118 | −17 | 13 | −32 | 5 | CR | 1.2 |
| 56 | N | Absent | 850 | 173 | 5 | 18 | −36 | 2 | CR | 1.2 |
| 57 | N | Present (Fe) | 852 | 120 | −17 | 16 | −33 | 5 | CR | 1.2 |
| 58 | N | Present (Fe) | 847 | 125 | 5 | 13 | −38 | 4 | CR | 1.2 |
| 59 | O | Absent | 854 | 120 | −13 | 16 | −45 | 6 | CR | 1.2 |
| 60 | O | Absent | 850 | 120 | 9 | 16 | −50 | 5 | CR | 1.2 |
| 61 | O | Present (Fe) | 851 | 134 | −13 | 16 | −47 | 5 | CR | 1.2 |
| 62 | O | Present (Fe) | 845 | 148 | 9 | 9 | −34 | 1 | CR | 1.2 |
| 63 | P | Absent | 875 | 152 | −15 | 14 | −45 | 3 | GA | 1.2 |
| 64 | P | Absent | 880 | 108 | 10 | 19 | −46 | 6 | GA | 1.2 |
| 65 | P | Present (Fe) | 878 | 131 | −15 | 9 | −40 | 2 | GA | 1.2 |
| 66 | P | Present (Fe) | 881 | 103 | 10 | 16 | −50 | 6 | GA | 1.2 |
| 67 | P | Present (Ni) | 882 | 121 | 10 | 9 | −47 | 6 | GA | 1.2 |
| 68 | Q | Absent | 800 | 145 | 10 | 10 | −38 | 5 | CR | 1.2 |
| 69 | R | Absent | 790 | 125 | 10 | 18 | −40 | 5 | CR | 1.2 |
| 70 | S | Absent | 855 | 105 | 10 | 16 | −40 | 2 | CR | 1.2 |
| 71 | T | Absent | 819 | 140 | 10 | 18 | −39 | 4 | CR | 1.2 |
| 72 | L | Absent | 700 | 108 | −27 | 19 | −40 | 3 | GA | 1.2 |
| 73 | L | Absent | 830 | 3 | 7 | 16 | −30 | 3 | GA | 1.2 |
| 74 | L | Absent | 831 | 137 | −40 | 11 | −39 | 5 | GA | 1.2 |
| 75 | L | Absent | 833 | 116 | 7 | 2 | −41 | 3 | GA | 1.2 |
| 76 | L | Absent | 828 | 133 | 7 | 9 | −37 | 20 | GA | 1.2 |
| 77 | U | Absent | 771 | 190 | 6 | 18 | −34 | 4 | CR | 1.2 |
| 78 | U | Present (Fe) | 778 | 202 | 6 | 19 | −44 | 1 | CR | 1.2 |
| 79 | V | Absent | 832 | 58 | 9 | 20 | −30 | 5 | AI | 1.2 |
| 80 | V | Present (Fe) | 831 | 55 | 9 | 19 | −35 | 5 | AI | 1.2 |
| 81 | W | Absent | 802 | 166 | −22 | 15 | −32 | 5 | EG | 1.2 |
| 82 | W | Present (Fe) | 805 | 156 | −22 | 12 | −44 | 1 | EG | 1.2 |
| 83 | X | Absent | 832 | 122 | 15 | 18 | −40 | 1 | GA | 1.2 |
| 84 | X | Present (Fe) | 835 | 126 | 15 | 15 | −46 | 5 | GA | 1.2 |
| 85 | Y | Absent | 810 | 122 | 10 | 13 | −41 | 6 | GI | 1.2 |
| 86 | Y | Present (Fe) | 808 | 175 | 10 | 14 | −32 | 3 | GI | 1.2 |
| 87 | Z | Absent | 841 | 176 | −5 | 18 | −38 | 2 | CR | 1.2 |
| 88 | Z | Present (Fe) | 838 | 113 | −5 | 19 | −46 | 4 | CR | 1.2 |
| 89 | AA | Absent | 890 | 149 | −6 | 11 | −45 | 4 | GI | 1.2 |
| 90 | AA | Present (Fe) | 899 | 106 | −6 | 20 | −45 | 5 | GI | 1.2 |
| 91 | AB | Absent | 889 | 118 | 0 | 15 | −35 | 4 | AI | 1.2 |
| 92 | AB | Present (Fe) | 892 | 176 | 0 | 10 | −33 | 5 | AI | 1.2 |
| 93 | AC | Absent | 912 | 149 | 5 | 10 | −36 | 4 | EG | 1.2 |
| 94 | AC | Present (Fe) | 908 | 106 | 5 | 14 | −32 | 2 | EG | 1.2 |
| 95 | AD | Absent | 880 | 118 | 5 | 14 | −43 | 6 | GI | 1.2 |
| 96 | AD | Present (Fe) | 879 | 176 | −5 | 19 | −46 | 4 | GI | 1.2 |
| 97 | I | Absent | 802 | 180 | −15 | 12 | −43 | 3 | GA | 2.3 |
| 98 | I | Absent | 805 | 103 | 10 | 12 | −32 | 4 | GA | 2.3 |
| 99 | I | Present (Fe) | 801 | 168 | −15 | 15 | −35 | 5 | GA | 2.3 |
| 100 | I | Present (Fe) | 803 | 126 | 10 | 10 | −40 | 2 | GA | 2.3 |
| 101 | L | Absent | 831 | 175 | −15 | 11 | −35 | 2 | GA | 2.3 |
| 102 | L | Absent | 834 | 125 | −5 | 14 | −36 | 4 | GA | 2.3 |
| 103 | L | Absent | 832 | 102 | 5 | 14 | −42 | 6 | GA | 2.3 |
| 104 | L | Present (Fe) | 833 | 164 | −15 | 15 | −48 | 1 | GA | 2.3 |
| 105 | L | Present (Fe) | 829 | 131 | 5 | 17 | −43 | 2 | GA | 2.3 |
| 106 | L | Present (Ni) | 831 | 124 | 5 | 16 | −33 | 6 | GA | 2.3 |

TABLE 3-continued

| No. | Microstructure at quarter thickness position: M (%) | RA (%) | TM (%) | Remainder microstructure | Surface layer: Soft layer thickness (μm) | Metal coating weight (*3) (g/m$^2$) | Surface nanohardness Hn: Ratio of Hn of 7.0 GPa or more (*4) | Standard deviation of Hn at quarter position (*5) (GPa) | Standard deviation of Hn at half position (*6) (GPa) | Surface roughness (*7) (μm) |
|---|---|---|---|---|---|---|---|---|---|---|
| 51 | 12.5 | 13.7 | 64.1 | F, B, θ | 16 | — | 0.07 | 1.5 | 1.8 | 5.4 |
| 52 | 12.1 | 13.0 | 63.6 | F, B, θ | 41 | — | 0.04 | 1.0 | 1.4 | 6.3 |
| 53 | 11.9 | 12.8 | 65.4 | F, B, θ | 25 | 10.0 | 0.05 | 1.4 | 1.6 | 1.0 |
| 54 | 12.7 | 12.4 | 66.2 | F, B, θ | 44 | 10.0 | 0.03 | 0.8 | 1.0 | 0.9 |
| 55 | 0.9 | 0.1 | 98.3 | θ | 14 | — | 0.07 | 1.5 | 1.9 | 7.1 |
| 56 | 1.0 | 0.1 | 98.5 | θ | 36 | — | 0.05 | 1.2 | 1.5 | 7.5 |
| 57 | 0.8 | 0.2 | 98.1 | θ | 23 | 10.0 | 0.06 | 1.4 | 1.7 | 2.4 |
| 58 | 1.1 | 0.2 | 99.0 | θ | 41 | 10.0 | 0.04 | 1.0 | 1.2 | 2.3 |
| 59 | 0.4 | 0.1 | 99.3 | θ | 16 | — | 0.08 | 1.6 | 1.9 | 6.8 |
| 60 | 0.3 | 0.1 | 99.5 | θ | 34 | — | 0.06 | 1.2 | 1.5 | 7.3 |
| 61 | 0.5 | 0.2 | 99.1 | θ | 26 | 13.0 | 0.07 | 1.5 | 1.7 | 2.6 |
| 62 | 0.6 | 0.2 | 99.0 | θ | 38 | 13.0 | 0.05 | 1.0 | 1.3 | 2.4 |
| 63 | 0.4 | 0.1 | 99.1 | θ | 17 | — | 0.08 | 1.6 | 1.9 | 3.5 |
| 64 | 0.3 | 0.1 | 99.3 | θ | 38 | — | 0.06 | 1.1 | 1.4 | 3.9 |
| 65 | 0.4 | 0.2 | 99.0 | θ | 28 | 10.0 | 0.07 | 1.4 | 1.6 | 0.8 |
| 66 | 0.3 | 0.1 | 99.2 | θ | 42 | 10.0 | 0.05 | 1.0 | 1.3 | 0.9 |
| 67 | 0.4 | 0.2 | 99.1 | θ | 48 | 10.0 | 0.01 | 0.7 | 0.8 | 1.0 |
| 68 | 39.3 | 8.3 | 50.9 | B, θ | 33 | — | 0.30 | 2.7 | 3.6 | 5.2 |
| 69 | 3.6 | 0.3 | 1.2 | F, θ | 42 | — | 0.01 | 0.1 | 0.3 | 5.8 |
| 70 | 42.4 | 4.3 | 4.1 | F, B, θ | 34 | — | 0.03 | 1.0 | 1.3 | 22.8 |
| 71 | 0.0 | 82.0 | 0.0 | θ, εM | 18 | — | 0.08 | 1.6 | 1.9 | 21.3 |
| 72 | 30.5 | 0.9 | 8.2 | F, F', B, θ | 10 | — | 0.20 | 2.1 | 2.4 | 0.9 |
| 73 | 2.7 | 1.0 | 56.0 | θ | 2 | — | 0.34 | 2.9 | 3.8 | 0.6 |
| 74 | 3.0 | 1.7 | 55.8 | θ | 1 | — | 0.36 | 2.8 | 3.7 | 0.3 |
| 75 | 3.0 | 1.8 | 56.4 | θ | 32 | — | 0.21 | 2.2 | 2.6 | 5.7 |
| 76 | 2.2 | 1.1 | 56.1 | θ | 38 | — | 0.22 | 2.3 | 2.7 | 6.1 |
| 77 | 44.1 | 0.4 | 2.8 | F, B, θ | 33 | — | 0.02 | 0.9 | 1.2 | 5.4 |
| 78 | 44.3 | 0.5 | 1.9 | F, B, θ | 41 | 10.0 | 0.01 | 0.5 | 0.8 | 1.8 |
| 79 | 33.2 | 0.6 | 11.7 | F, B, θ | 33 | — | 0.02 | 0.9 | 1.2 | 8.2 |
| 80 | 32.3 | 0.8 | 11.1 | F, B, θ | 41 | 10.0 | 0.01 | 0.5 | 0.8 | 2.2 |
| 81 | 5.5 | 11.5 | 14.6 | F, B, θ | 38 | — | 0.04 | 1.2 | 1.6 | 6.8 |
| 82 | 5.8 | 12.9 | 16.5 | F, B, θ | 44 | 13.0 | 0.02 | 0.7 | 1.1 | 1.5 |
| 83 | 4.1 | 0.4 | 61.4 | B, θ | 89 | — | 0.02 | 0.7 | 0.8 | 7.9 |
| 84 | 3.3 | 0.5 | 62.4 | B, θ | 102 | 10.0 | 0.01 | 0.5 | 0.6 | 2.0 |
| 85 | 3.3 | 0.5 | 61.2 | B, θ | 71 | — | 0.02 | 0.9 | 1.1 | 5.1 |
| 86 | 4.5 | 0.3 | 61.8 | B, θ | 84 | 10.0 | 0.01 | 0.7 | 0.9 | 1.7 |
| 87 | 12.1 | 13.0 | 63.6 | F, B, θ | 41 | — | 0.04 | 1.0 | 1.4 | 6.3 |
| 88 | 12.7 | 12.4 | 66.2 | F, B, θ | 44 | 10.0 | 0.03 | 0.8 | 1.0 | 2.2 |
| 89 | 0.8 | 0.1 | 98.5 | θ | 33 | — | 0.05 | 1.1 | 1.4 | 6.1 |
| 90 | 0.7 | 0.2 | 98.9 | θ | 45 | 13.0 | 0.04 | 0.9 | 1.2 | 2.3 |
| 91 | 0.8 | 0.2 | 98.3 | θ | 34 | — | 0.05 | 1.1 | 1.5 | 7.8 |
| 92 | 1.0 | 0.1 | 98.2 | θ | 40 | 10.0 | 0.04 | 0.9 | 1.3 | 1.9 |
| 93 | 0.7 | 0.3 | 98.9 | θ | 32 | — | 0.06 | 1.2 | 1.4 | 4.8 |
| 94 | 0.7 | 0.2 | 98.8 | θ | 43 | 10.0 | 0.05 | 1.0 | 1.2 | 1.0 |
| 95 | 0.8 | 0.1 | 98.5 | θ | 35 | — | 0.05 | 1.1 | 1.4 | 5.4 |
| 96 | 0.7 | 0.2 | 98.9 | θ | 48 | 13.0 | 0.04 | 0.9 | 1.2 | 1.8 |
| 97 | 40.6 | 0.6 | 4.3 | F, B, θ | 20 | — | 0.04 | 1.3 | 1.5 | 3.5 |
| 98 | 41.1 | 0.5 | 3.9 | F, B, θ | 34 | — | 0.02 | 0.9 | 1.1 | 4.9 |
| 99 | 41.4 | 0.3 | 4.2 | F, B, θ | 25 | 10.0 | 0.03 | 1.1 | 1.3 | 0.6 |
| 100 | 40.8 | 0.5 | 4.1 | F, B, θ | 50 | 10.0 | 0.01 | 0.5 | 0.8 | 0.5 |
| 101 | 3.8 | 1.1 | 60.1 | B, θ | 19 | — | 0.08 | 1.5 | 1.8 | 3.8 |
| 102 | 3.2 | 0.4 | 59.4 | B, θ | 41 | — | 0.05 | 1.0 | 1.3 | 4.6 |
| 103 | 3.1 | 0.5 | 59.3 | B, θ | 78 | — | 0.02 | 0.9 | 1.0 | 5.6 |
| 104 | 3.5 | 1.0 | 58.5 | B, θ | 25 | 10.0 | 0.07 | 1.4 | 1.5 | 1.0 |
| 105 | 3.2 | 0.4 | 59.1 | B, θ | 92 | 10.0 | 0.01 | 0.6 | 0.7 | 0.8 |
| 106 | 3.0 | 0.8 | 59.4 | B, θ | 88 | 10.0 | 0.02 | 0.7 | 0.8 | 0.9 |

| No. | Evaluation: YS (MPa) | TS (MPa) | EI (%) | λ (%) | R/t | V-bending + VDA bending SFmax (mm) | Axial crushing characteristics | Note |
|---|---|---|---|---|---|---|---|---|
| 51 | 833 | 1206 | 13.7 | 40 | 1.25 | 26.3 | Good | Inventive example |
| 52 | 882 | 1203 | 14.4 | 33 | 0.42 | 28.1 | Excellent | Inventive example |
| 53 | 881 | 1218 | 14.3 | 40 | 0.83 | 27.0 | Excellent | Inventive example |
| 54 | 887 | 1218 | 15.5 | 33 | 0.00 | 28.9 | Excellent | Inventive example |
| 55 | 1154 | 1334 | 7.5 | 45 | 2.50 | 24.8 | Good | Inventive example |

TABLE 3-continued

| | | | | | | | | |
|---|---|---|---|---|---|---|---|---|
| 56 | 1165 | 1342 | 7.7 | 45 | 1.25 | 25.7 | Excellent | Inventive example |
| 57 | 1169 | 1344 | 7.8 | 49 | 2.08 | 25.2 | Excellent | Inventive example |
| 58 | 1150 | 1330 | 7.5 | 45 | 0.83 | 26.0 | Excellent | Inventive example |
| 59 | 1245 | 1504 | 7.4 | 48 | 2.50 | 24.2 | Good | Inventive example |
| 60 | 1247 | 1528 | 7.7 | 39 | 1.25 | 25.2 | Excellent | Inventive example |
| 61 | 1250 | 1510 | 7.9 | 45 | 1.67 | 24.9 | Excellent | Inventive example |
| 62 | 1241 | 1518 | 7.7 | 38 | 0.83 | 26.0 | Excellent | Inventive example |
| 63 | 1249 | 1518 | 7.5 | 45 | 2.50 | 24.3 | Good | Inventive example |
| 64 | 1244 | 1526 | 7.8 | 43 | 1.25 | 25.4 | Excellent | Inventive example |
| 65 | 1242 | 1529 | 7.7 | 48 | 1.67 | 25.0 | Excellent | Inventive example |
| 66 | 1247 | 1518 | 7.5 | 48 | 0.83 | 26.2 | Excellent | Inventive example |
| 67 | 1248 | 1526 | 7.8 | 41 | 0.83 | 26.0 | Excellent | Inventive example |
| 68 | 963 | 1634 | 4.2 | 12 | 5.83 | 22.2 | Poor | comparative example |
| 69 | 234 | 354 | 38.9 | 92 | 0.00 | 31.2 | Excellent | comparative example |
| 70 | 651 | 997 | 3.2 | 14 | 5.00 | 23.1 | Poor | comparative example |
| 71 | 320 | 795 | 17.0 | 13 | 3.33 | 25.4 | Poor | comparative example |
| 72 | 601 | 1012 | 10.0 | 19 | 3.75 | 25.1 | Poor | comparative example |
| 73 | 810 | 1198 | 8.9 | 28 | 3.75 | 25.5 | Poor | comparative example |
| 74 | 832 | 1221 | 9.2 | 30 | 3.75 | 25.2 | Poor | comparative example |
| 75 | 825 | 1213 | 9.6 | 32 | 3.33 | 25.2 | Poor | comparative example |
| 76 | 828 | 1209 | 9.5 | 35 | 3.33 | 25.2 | Poor | comparative example |
| 77 | 639 | 991 | 16.9 | 28 | 0.83 | 28.4 | Excellent | Inventive example |
| 78 | 627 | 990 | 16.8 | 33 | 0.00 | 29.1 | Excellent | Inventive example |
| 79 | 645 | 1021 | 15.1 | 34 | 0.42 | 28.2 | Excellent | Inventive example |
| 80 | 651 | 1027 | 15.0 | 37 | 0.00 | 29.3 | Excellent | Inventive example |
| 81 | 636 | 1022 | 21.7 | 29 | 0.42 | 28.1 | Excellent | Inventive example |
| 82 | 624 | 1027 | 21.5 | 24 | 0.00 | 29.2 | Excellent | Inventive example |
| 83 | 853 | 1198 | 11.4 | 41 | 0.83 | 29.8 | Excellent | Inventive example |
| 84 | 859 | 1199 | 11.7 | 36 | 0.00 | 30.7 | Excellent | Inventive example |
| 85 | 867 | 1212 | 11.5 | 35 | 1.25 | 28.7 | Excellent | Inventive example |
| 86 | 872 | 1223 | 11.1 | 32 | 0.00 | 29.5 | Excellent | Inventive example |
| 87 | 892 | 1203 | 14.4 | 35 | 0.83 | 28.2 | Excellent | Inventive example |
| 88 | 863 | 1217 | 15.5 | 38 | 0.00 | 29.2 | Excellent | Inventive example |
| 89 | 1242 | 1495 | 7.3 | 37 | 1.25 | 25.6 | Excellent | Inventive example |
| 90 | 1233 | 1503 | 7.4 | 39 | 0.42 | 26.7 | Excellent | Inventive example |
| 91 | 1238 | 1502 | 7.6 | 40 | 1.25 | 25.3 | Excellent | Inventive example |
| 92 | 1246 | 1505 | 7.4 | 42 | 0.83 | 26.4 | Excellent | Inventive example |
| 93 | 1219 | 1521 | 7.9 | 38 | 0.83 | 25.4 | Excellent | Inventive example |
| 94 | 1214 | 1516 | 7.0 | 37 | 0.42 | 26.5 | Excellent | Inventive example |
| 95 | 1242 | 1498 | 7.8 | 38 | 1.25 | 25.7 | Excellent | Inventive example |
| 96 | 1239 | 1500 | 7.9 | 39 | 0.42 | 26.9 | Excellent | Inventive example |
| 97 | 653 | 1024 | 16.5 | 34 | 0.87 | 27.1 | Good | Inventive example |
| 98 | 641 | 1032 | 16.9 | 32 | 0.00 | 29.3 | Excellent | Inventive example |
| 99 | 636 | 1031 | 16.2 | 33 | 0.43 | 28.4 | Excellent | Inventive example |
| 100 | 631 | 1033 | 17.0 | 35 | 0.00 | 29.7 | Excellent | Inventive example |
| 101 | 836 | 1211 | 12.5 | 45 | 1.52 | 26.5 | Good | Inventive example |
| 102 | 844 | 1208 | 12.8 | 43 | 0.65 | 27.3 | Excellent | Inventive example |
| 103 | 849 | 1203 | 13.0 | 42 | 0.00 | 28.8 | Excellent | Inventive example |
| 104 | 851 | 1221 | 12.7 | 44 | 1.30 | 26.9 | Excellent | Inventive example |
| 105 | 845 | 1209 | 12.8 | 46 | 0.00 | 29.4 | Excellent | Inventive example |
| 106 | 841 | 1224 | 12.9 | 48 | 0.00 | 29.2 | Excellent | Inventive example |

(*1) Average cooling rate in temperature range of Ac1 point to 450° C. (° C./s)

(*2) Average cooling rate in temperature range of less than 450° C. to 300° C. (° C./s)

(*3) Metal coating weight (g/m$^2$): first coating weight (g/m$^2$)

(*4) Ratio of number of measurements of nanohardness of 7.0 GPa or more on sheet surface at quarter depth position in thickness direction of surface soft layer from surface of base steel sheet to total number of measurements (*5) Standard deviation σ of nanohardness of sheet surface at quarter depth position in thickness direction of surface soft layer from surface of base steel sheet (GPa)

(*6) Standard deviation σ of nanohardness of sheet surface at half depth position in thickness direction of surface soft layer from surface of base steel sheet (GPa)

(*7) Surface roughness depth of test specimen after 90-degree V-bending in which R/t obtained by dividing critical bending radius R by thickness t is 4.5 or more and 5.0 or less (μm)

TABLE 4

| | | Production conditions | | | | | | | | |
|---|---|---|---|---|---|---|---|---|---|---|
| | | First coating Presence or | Annealing | | | First cooling | | Second cooling | | Reheating and holding |
| No. | Type of steel | absence (Coating type) | Annealing temperature (° C.) | Annealing time (s) | Dew-point temperature (° C.) | Average cooling rate (*1) (° C./s) | Dew-point temperature (° C.) | Average cooling rate (*2) (° C./s) | Second coating Type | Cooling stop temperature (° C.) |
| 107 | F | Absent | 830 | 135 | −15 | 14 | −48 | 3 | GA | 200 |
| 108 | F | Absent | 827 | 141 | 10 | 15 | −47 | 6 | GA | 200 |
| 109 | F | Present (Fe) | 822 | 152 | −15 | 12 | −35 | 5 | GA | 200 |
| 110 | F | Present (Fe) | 825 | 173 | 10 | 10 | −39 | 6 | GA | 200 |
| 111 | F | Absent | 828 | 142 | 10 | 15 | −46 | 6 | GA | — |
| 112 | H | Absent | 825 | 98 | −13 | 16 | −38 | 5 | GA | 40 |

TABLE 4-continued

| | | | | | | | | | | |
|---|---|---|---|---|---|---|---|---|---|---|
| 113 | H | Absent | 818 | 152 | 8 | 18 | −35 | 1 | GA | 40 |
| 114 | H | Present (Fe) | 822 | 134 | −13 | 15 | −47 | 6 | GA | 40 |
| 115 | H | Present (Fe) | 829 | 155 | 8 | 15 | −39 | 3 | GA | 40 |
| 116 | H | Absent | 819 | 152 | 8 | 17 | −34 | 2 | GA | — |
| 117 | L | Absent | 834 | 170 | −14 | 14 | −37 | 2 | GA | 50 |
| 118 | L | Absent | 833 | 97 | 6 | 16 | −31 | 3 | GA | 50 |
| 119 | L | Present (Fe) | 838 | 159 | −14 | 13 | −35 | 2 | GA | 50 |
| 120 | L | Present (Fe) | 830 | 126 | 6 | 12 | −31 | 2 | GA | 50 |
| 121 | L | Absent | 832 | 99 | 6 | 15 | −31 | 3 | GA | — |
| 122 | M | Absent | 822 | 166 | −15 | 14 | −36 | 3 | GA | 180 |
| 123 | M | Absent | 824 | 153 | 7 | 16 | −41 | 2 | GA | 180 |
| 124 | M | Present (Fe) | 825 | 117 | −15 | 19 | −44 | 5 | GA | 180 |
| 125 | M | Present (Fe) | 822 | 119 | 7 | 11 | −45 | 1 | GA | 180 |
| 126 | M | Absent | 823 | 158 | 7 | 15 | −40 | 2 | GA | — |
| 127 | P | Absent | 877 | 147 | −12 | 15 | −43 | 3 | GA | 30 |
| 128 | P | Absent | 882 | 103 | 10 | 20 | −44 | 6 | GA | 30 |
| 129 | P | Present (Fe) | 880 | 126 | −12 | 10 | −38 | 2 | GA | 30 |
| 130 | P | Present (Fe) | 883 | 98 | 10 | 15 | −48 | 6 | GA | 30 |
| 131 | AE | Absent | 880 | 165 | −28 | 9 | −35 | 7 | CR | 30 |
| 132 | AE | Absent | 882 | 160 | −5 | 9 | −36 | 7 | CR | 30 |
| 133 | AE | Present (Fe) | 885 | 180 | −28 | 10 | −35 | 7 | CR | 30 |
| 134 | AE | Present (Fe) | 883 | 175 | −5 | 9 | −37 | 7 | CR | 30 |
| 135 | AF | Absent | 872 | 90 | −15 | 13 | −43 | 3 | GA | 50 |
| 136 | AF | Absent | 880 | 94 | 10 | 17 | −45 | 3 | GA | 50 |
| 137 | AF | Present (Fe) | 876 | 88 | −15 | 15 | −44 | 4 | GA | 50 |
| 138 | AF | Present (Fe) | 874 | 98 | 10 | 14 | −38 | 3 | GA | 50 |
| 139 | AG | Absent | 885 | 115 | −12 | 13 | −42 | 4 | GA | 60 |
| 140 | AG | Absent | 880 | 110 | 8 | 17 | −44 | 4 | GA | 60 |
| 141 | AG | Present (Fe) | 882 | 108 | −12 | 15 | −45 | 3 | GA | 60 |
| 142 | AG | Present (Fe) | 883 | 112 | 8 | 16 | −39 | 3 | GA | 60 |
| 143 | H | Absent | 823 | 102 | −15 | 15 | −35 | 4 | GA | — |
| 144 | H | Absent | 820 | 95 | 10 | 17 | −38 | 3 | GA | — |
| 145 | H | Present (Fe) | 822 | 121 | −15 | 16 | −42 | 5 | GA | — |
| 146 | H | Present (Fe) | 825 | 112 | 10 | 15 | −41 | 2 | GA | — |

| | Production conditions Reheating and holding | | | Microstructure at quarter thickness position | | | | Surface layer | | | |
|---|---|---|---|---|---|---|---|---|---|---|---|
| | Reheating | Reheating and | | | | | | Soft layer | | | Metal coating |
| No. | temperature (° C.) | holding time (s) | Thickness (mm) | M (%) | RA (%) | TM (%) | Remainder microstructure | thickness (μm) | F + B (*8) (%) | M/(M + TM) (*9) | weight (*3) (g/m$^2$) |
| 107 | 360 | 100 | 1.2 | 4.1 | 8.7 | 51.3 | F, B, θ | 19 | 62 | 0.16 | — |
| 108 | 360 | 100 | 1.2 | 4.4 | 8.3 | 49.7 | F, B, θ | 62 | 87 | 0.33 | — |
| 109 | 360 | 100 | 1.2 | 4.8 | 8.6 | 50.1 | F, B, θ | 33 | 75 | 0.21 | 10.0 |
| 110 | 360 | 100 | 1.2 | 4.3 | 8.1 | 50.9 | F, B, θ | 70 | 92 | 0.14 | 10.0 |
| 111 | — | — | 1.2 | 5.8 | 9.3 | 48.1 | F, B, θ | 60 | 73 | 0.38 | — |
| 112 | 200 | 60 | 1.2 | 9.1 | 0.5 | 40.2 | F, B, θ | 14 | 57 | 0.22 | — |
| 113 | 200 | 60 | 1.2 | 8.2 | 0.8 | 41.1 | F, B, θ | 36 | 86 | 0.31 | — |
| 114 | 200 | 60 | 1.2 | 8.1 | 0.6 | 40.5 | F, B, θ | 18 | 66 | 0.12 | 10.0 |
| 115 | 200 | 60 | 1.2 | 8.5 | 0.7 | 40.9 | F, B, θ | 41 | 89 | 0.20 | 10.0 |
| 116 | — | — | 1.2 | 39.2 | 0.8 | 10.1 | F, B, θ | 35 | 82 | 0.35 | — |
| 117 | 220 | 40 | 1.2 | 1.8 | 0.9 | 78.2 | B, θ | 19 | 45 | 0.23 | — |
| 118 | 220 | 40 | 1.2 | 1.5 | 0.7 | 76.6 | B, θ | 68 | 84 | 0.33 | — |
| 119 | 220 | 40 | 1.2 | 1.8 | 1.0 | 77.3 | B, θ | 26 | 69 | 0.17 | 10.0 |
| 120 | 220 | 40 | 1.2 | 1.2 | 0.5 | 77.1 | B, θ | 83 | 88 | 0.09 | 10.0 |
| 121 | — | — | 1.2 | 4.2 | 0.9 | 63.6 | B, θ | 66 | 82 | 0.35 | — |
| 122 | 400 | 90 | 1.2 | 9.8 | 11.2 | 69.1 | F, B, θ | 14 | 47 | 0.13 | — |
| 123 | 400 | 90 | 1.2 | 10.2 | 11.0 | 69.6 | F, B, θ | 42 | 87 | 0.33 | — |
| 124 | 400 | 90 | 1.2 | 9.9 | 10.4 | 69.4 | F, B, θ | 23 | 66 | 0.18 | 10.0 |
| 125 | 400 | 90 | 1.2 | 10.5 | 10.2 | 69.2 | F, B, θ | 49 | 88 | 0.18 | 10.0 |
| 126 | — | — | 1.2 | 14.4 | 13.0 | 41.6 | F, B, θ | 43 | 86 | 0.31 | — |
| 127 | 280 | 50 | 1.2 | 2.3 | 3.8 | 92.2 | B, θ | 15 | 50 | 0.10 | — |
| 128 | 280 | 50 | 1.2 | 2.5 | 3.2 | 92.3 | B, θ | 41 | 83 | 0.20 | — |
| 129 | 280 | 50 | 1.2 | 2.7 | 3.1 | 92.1 | B, θ | 26 | 61 | 0.16 | 10.0 |
| 130 | 280 | 50 | 1.2 | 2.2 | 3.5 | 92.3 | B, θ | 48 | 87 | 0.27 | 10.0 |
| 131 | 200 | 900 | 1.2 | 0.3 | 0.3 | 99.1 | θ | 12 | 26 | 0.07 | — |
| 132 | 200 | 900 | 1.2 | 0.4 | 0.3 | 99.2 | θ | 35 | 49 | 0.08 | — |
| 133 | 200 | 900 | 1.2 | 0.3 | 0.2 | 99.1 | θ | 15 | 31 | 0.07 | 10.0 |
| 134 | 200 | 900 | 1.2 | 0.2 | 0.3 | 99.1 | θ | 39 | 54 | 0.09 | 10.0 |
| 135 | 170 | 150 | 1.2 | 3.5 | 4.1 | 91.4 | B, θ | 13 | 21 | 0.04 | — |
| 136 | 170 | 150 | 1.2 | 3.6 | 4.2 | 91.6 | B, θ | 43 | 38 | 0.03 | — |
| 137 | 170 | 150 | 1.2 | 3.3 | 4.5 | 91.3 | B, θ | 29 | 23 | 0.04 | 10.0 |
| 138 | 170 | 150 | 1.2 | 3.5 | 4.7 | 91.2 | B, θ | 51 | 37 | 0.07 | 10.0 |
| 139 | 300 | 50 | 1.2 | 3.8 | 4.3 | 91.5 | B, θ | 18 | 21 | 0.03 | — |
| 140 | 300 | 50 | 1.2 | 3.7 | 4.1 | 91.4 | B, θ | 39 | 32 | 0.03 | — |
| 141 | 300 | 50 | 1.2 | 3.9 | 4.2 | 91.6 | B, θ | 29 | 22 | 0.04 | 12.0 |
| 142 | 300 | 50 | 1.2 | 3.7 | 4.2 | 91.3 | B, θ | 47 | 36 | 0.03 | 12.0 |
| 143 | — | — | 1.2 | 8.9 | 0.4 | 39.5 | F, B, θ | 15 | 58 | 0.21 | — |

TABLE 4-continued

| | | | | | | | | | | | |
|---|---|---|---|---|---|---|---|---|---|---|---|
| 144 | — | — | 1.2 | 8.4 | 0.5 | 40.2 | F, B, θ | 35 | 86 | 0.31 | — |
| 145 | — | — | 1.2 | 8.3 | 0.7 | 40.6 | F, B, θ | 20 | 65 | 0.09 | 8.0 |
| 146 | — | — | 1.2 | 8.6 | 0.6 | 40.1 | F, B, θ | 48 | 90 | 0.22 | 8.0 |

| | Surface nanohardness Hn | | | | Evaluation | | | | | | | |
|---|---|---|---|---|---|---|---|---|---|---|---|---|
| No. | Ratio of Hn of 7.0 GPa or more (*4) | Standard deviation of Hn at quarter position (*5) (GPa) | Standard deviation of Hn at half position (*6) (GPa) | Surface roughness (*7) (μm) | YS (MPa) | TS (MPa) | EI (%) | λ (%) | R/t | V-bending + VDA bending SFmax (mm) | Axial crushing characteristics | Note |
| 107 | 0.09 | 1.7 | 2.1 | 7.0 | 900 | 1036 | 16.2 | 72 | 1.04 | 28.1 | Excellent | Inventive example |
| 108 | 0.04 | 0.7 | 1.1 | 7.8 | 896 | 1035 | 15.6 | 75 | 0.00 | 30.5 | Excellent | Inventive example |
| 109 | 0.05 | 0.9 | 1.2 | 1.8 | 892 | 1033 | 15.8 | 75 | 0.21 | 28.4 | Excellent | Inventive example |
| 110 | 0.03 | 0.5 | 0.8 | 1.9 | 900 | 1044 | 16.1 | 74 | 0.00 | 31.0 | Excellent | Inventive example |
| 111 | 0.06 | 0.9 | 1.4 | 7.6 | 838 | 1040 | 15.6 | 62 | 0.21 | 28.9 | Excellent | Inventive example |
| 112 | 0.06 | 1.4 | 1.7 | 5.1 | 691 | 1025 | 16.2 | 32 | 1.04 | 28.0 | Excellent | Inventive example |
| 113 | 0.04 | 1.0 | 1.3 | 6.3 | 703 | 1017 | 16.7 | 33 | 0.21 | 29.3 | Excellent | Inventive example |
| 114 | 0.04 | 1.3 | 1.5 | 0.7 | 704 | 1020 | 16.3 | 34 | 0.63 | 28.7 | Excellent | Inventive example |
| 115 | 0.02 | 0.5 | 0.8 | 0.9 | 691 | 1011 | 16.5 | 35 | 0.00 | 29.9 | Excellent | Inventive example |
| 116 | 0.05 | 1.2 | 1.5 | 6.2 | 609 | 1002 | 16.5 | 24 | 0.42 | 29.3 | Excellent | Inventive example |
| 117 | 0.08 | 1.4 | 1.8 | 3.8 | 1023 | 1238 | 10.2 | 40 | 1.46 | 26.6 | Excellent | Inventive example |
| 118 | 0.02 | 0.8 | 0.9 | 4.7 | 1034 | 1200 | 10.3 | 46 | 0.00 | 29.2 | Excellent | Inventive example |
| 119 | 0.07 | 1.3 | 1.6 | 0.4 | 1029 | 1226 | 11.0 | 47 | 1.04 | 27.1 | Excellent | Inventive example |
| 120 | 0.01 | 0.6 | 0.7 | 0.3 | 1035 | 1206 | 10.3 | 41 | 0.00 | 29.5 | Excellent | Inventive example |
| 121 | 0.04 | 0.9 | 1.1 | 4.5 | 833 | 1215 | 10.1 | 32 | 0.63 | 27.7 | Excellent | Inventive example |
| 122 | 0.07 | 1.4 | 1.7 | 5.1 | 997 | 1202 | 14.7 | 55 | 1.04 | 26.5 | Excellent | Inventive example |
| 123 | 0.04 | 0.9 | 1.3 | 6.2 | 990 | 1197 | 14.3 | 52 | 0.21 | 28.3 | Excellent | Inventive example |
| 124 | 0.05 | 1.3 | 1.5 | 1.1 | 998 | 1200 | 14.4 | 55 | 0.63 | 27.2 | Excellent | Inventive example |
| 125 | 0.03 | 0.7 | 0.9 | 0.9 | 988 | 1193 | 15.1 | 58 | 0.00 | 29.1 | Excellent | Inventive example |
| 126 | 0.05 | 1.1 | 1.4 | 6.5 | 835 | 1253 | 14.6 | 39 | 0.63 | 28.3 | Excellent | Inventive example |
| 127 | 0.09 | 1.5 | 1.8 | 3.7 | 1269 | 1512 | 7.6 | 49 | 2.29 | 24.7 | Excellent | Inventive example |
| 128 | 0.07 | 1.0 | 1.3 | 4.0 | 1264 | 1504 | 7.8 | 47 | 1.04 | 25.6 | Excellent | Inventive example |
| 129 | 0.08 | 1.3 | 1.5 | 0.7 | 1262 | 1509 | 7.5 | 52 | 1.46 | 25.2 | Excellent | Inventive example |
| 130 | 0.06 | 0.9 | 1.2 | 0.8 | 1267 | 1497 | 7.9 | 51 | 0.63 | 26.4 | Excellent | Inventive example |
| 131 | 0.08 | 1.7 | 1.9 | 4.5 | 1515 | 1818 | 7.1 | 34 | 3.54 | 24.8 | Excellent | Inventive example |
| 132 | 0.06 | 1.1 | 1.3 | 4.7 | 1509 | 1808 | 7.2 | 35 | 2.29 | 25.3 | Excellent | Inventive example |
| 133 | 0.07 | 1.3 | 1.6 | 1.1 | 1511 | 1814 | 7.1 | 36 | 2.71 | 25.0 | Excellent | Inventive example |
| 134 | 0.04 | 0.9 | 1.2 | 1.0 | 1505 | 1802 | 7.1 | 35 | 1.88 | 26.1 | Excellent | Inventive example |
| 135 | 0.08 | 1.5 | 1.8 | 3.4 | 1443 | 1821 | 8.1 | 31 | 3.13 | 24.5 | Excellent | Inventive example |
| 136 | 0.06 | 1.0 | 1.3 | 3.8 | 1436 | 1812 | 8.2 | 33 | 1.88 | 25.2 | Excellent | Inventive example |
| 137 | 0.07 | 1.3 | 1.5 | 0.7 | 1440 | 1814 | 8.2 | 32 | 2.29 | 24.9 | Excellent | Inventive example |
| 138 | 0.05 | 0.9 | 1.2 | 0.6 | 1432 | 1807 | 8.3 | 31 | 1.46 | 25.9 | Excellent | Inventive example |
| 139 | 0.09 | 1.5 | 1.8 | 3.7 | 1705 | 2013 | 7.1 | 25 | 3.54 | 24.2 | Excellent | Inventive example |
| 140 | 0.07 | 1.0 | 1.3 | 3.8 | 1698 | 2009 | 7.1 | 26 | 2.71 | 25.0 | Excellent | Inventive example |
| 141 | 0.08 | 1.3 | 1.5 | 0.8 | 1701 | 2010 | 7.0 | 27 | 3.13 | 24.6 | Excellent | Inventive example |
| 142 | 0.06 | 0.9 | 1.2 | 0.7 | 1693 | 2002 | 7.2 | 26 | 2.29 | 25.7 | Excellent | Inventive example |
| 143 | 0.07 | 1.5 | 1.8 | 5.9 | 705 | 1029 | 16.1 | 34 | 1.04 | 28.2 | Excellent | Inventive example |
| 144 | 0.04 | 1.0 | 1.2 | 6.5 | 712 | 1018 | 16.2 | 36 | 0.21 | 29.6 | Excellent | Inventive example |
| 145 | 0.05 | 1.2 | 1.5 | 0.9 | 715 | 1026 | 16.1 | 35 | 0.63 | 28.9 | Excellent | Inventive example |
| 146 | 0.02 | 0.6 | 0.9 | 0.8 | 698 | 1009 | 16.4 | 37 | 0.00 | 30.1 | Excellent | Inventive example |

(*1) Average cooling rate in temperature range of Ac1 point to 450° C. (° C./s)

(*2) Average cooling rate in temperature range of less than 450° C. to 300° C. (° C./s)

(*3) Metal coating weight (g/m$^2$): first coating weight (g/m$^2$)

(*4) Ratio of number of measurements of nanohardness of 7.0 GPa or more on sheet surface at quarter depth position in thickness direction of surface soft layer from surface of base steel sheet to total number of measurements (*5) Standard deviation σ of nanohardness of sheet surface at quarter depth position in thickness direction of surface soft layer from surface of base steel sheet (GPa)

(*6) Standard deviation σ of nanohardness of sheet surface at half depth position in thickness direction of surface soft layer from surface of base steel sheet (GPa)

(*7) Surface roughness depth of test specimen after 90-degree V-bending in which R/t obtained by dividing critical bending radius R by thickness t is 4.5 or more and 5.0 or less (μm)

(*8) Total area fraction of ferrite and bainite present in surface soft layer (%)

(*9) (Area fraction of martensite present in surface soft layer)/(total area fraction of martensite and tempered martensite present in surface soft layer)

As shown in Tables 2 to 4, all the inventive examples passed all the tensile strength (TS), the yield stress (YS), the total elongation (El), the limiting hole expansion ratio (λ), R/t in the V-bending test, and the stroke at the maximum load (SFmax) measured in the V-bending+orthogonal VDA bending test, and had no fracture (appearance crack) in the axial crushing test.

By contrast, Comparative Examples were not satisfactory in at least one of the tensile strength (TS), the yield stress (YS), the total elongation (El), the limiting hole expansion ratio (λ), R/t in the V-bending test, the stroke at the maximum load (SFmax) measured in the V-bending+orthogonal VDA bending test, and the presence or absence of fracture (appearance crack) in the axial crushing test.

Thus, it was found that a steel sheet according to aspects of the present invention has high strength, high press formability, and good anti-crash property.

It was also found that, due to high strength, high press formability, and good anti-crash property of the steel sheets of the inventive examples, the members produced by forming, joining, or forming and joining the steel sheets of the inventive examples had high strength, high press formability, and good anti-crash property, similarly to the steel sheets of the inventive examples.

INDUSTRIAL APPLICABILITY

Aspects of the present invention enable the production of a steel sheet and a member with a TS of 590 MPa or more, high YS, high press formability (ductility, flangeability, and bendability), and fracture resistance characteristics (bending fracture characteristics and axial crushing characteristics) in case of a collision. A steel sheet and a member produced by a method according to aspects of the present invention can improve, for example, fuel efficiency due to the weight reduction of automobile bodies when used in automobile structural members and have significantly high industrial utility value.

The invention claimed is:

1. A steel sheet comprising:

a base steel sheet with a chemical composition containing, on a mass percent basis, C: 0.030% or more and 0.500% or less, Si: 0.01% or more and 3.00% or less, Mn: 0.30% or more and less than 10.00%, P: 0.001% or more and 0.100% or less, S: 0.0200% or less, Al: 0.005% or more and 2.000% or less, and N: 0.0100% or less, wherein Ceq represented by the following formula (1) satisfies 0.30% or more and 0.85% or less, the remainder being Fe and incidental impurities, a surface soft layer with a Vickers hardness of 85% or less with respect to a Vickers hardness at a quarter thickness position of the base steel sheet is formed in a region of 200 μm or less from a surface of the base steel sheet in a thickness direction, when nanohardness is measured at 300 points or more in a 50 μm×50 μm region on a sheet surface at a quarter depth position in the thickness direction and at a half depth position in the thickness direction of the surface soft layer from the surface of the base steel sheet, a ratio of a number of measurements with a nanohardness of 7.0 GPa or more on the sheet surface at the quarter depth position in the thickness direction of the surface soft layer from the surface of the base steel sheet to a total number of measurements is 0.10 or less, the nanohardness of the sheet surface at the quarter depth position in the thickness direction of the surface soft layer from the surface of the base steel sheet has a standard deviation σ of 1.8 GPa or less, and the nanohardness of the sheet surface at the half depth position in the thickness direction of the surface soft layer from the surface of the base steel sheet has a standard deviation σ of 2.2 GPa or less, $$Ceq = [\%\ C] + [\%\ Mn]/6 + [\%\ Si]/24 + [\%\ Ni]/40 + [\%\ Cr]/5 + [\%\ Mo]/4 + [\%\ V]/14 \quad \text{formula (1)}$$

wherein [% C] denotes a C content, [% Mn] denotes a Mn content, [% Si] denotes a Si content, [% Ni] denotes a Ni content, [% Cr] denotes a Cr content, [% Mo] denotes a Mo content, and [% V] denotes a V content, and these are 0 (zero) when not contained.

2. The steel sheet according to claim 1, wherein the chemical composition further contains, on a mass percent basis, at least one element selected from Nb: 0.200% or less, Ti: 0.200% or less, V: 0.200% or less, B: 0.0100% or less, Cr: 1.000% or less, Ni: 1.000% or less, Mo: 1.000% or less, Sb: 0.200% or less, Sn: 0.200% or less, Cu: 1.000% or less, Ta: 0.100% or less, W: 0.500% or less, Mg: 0.0200% or less, Zn: 0.0200% or less, Co: 0.0200% or less, Zr: 0.1000% or less, Ca: 0.0200% or less, Se: 0.0200% or less, Te: 0.0200% or less, Ge: 0.0200% or less, As: 0.0500% or less, Sr: 0.0200% or less, Cs: 0.0200% or less, Hf: 0.0200% or less, Pb: 0.0200% or less, Bi: 0.0200% or less, and REM: 0.0200% or less.

3. The steel sheet according to claim 1, comprising one or two or more selected from the following (1) to (4):

(1) wherein ferrite and bainite present in the surface soft layer have a total area fraction of 20% or more, and an area fraction of martensite present in the surface soft layer divided by a total area fraction of martensite and tempered martensite present in the surface soft layer is 0.45 or less, (2) comprising a metal coated layer as a first coated layer on one or both surfaces of the base steel sheet, (3) comprising a metal coated layer as a second coated layer on an outermost surface layer of one or both surfaces of the steel sheet, and (4) wherein a test specimen after 90-degree V-bending in which R/t obtained by dividing a critical bending radius R by a sheet thickness t is 4.5 or more and 5.0 or less has a surface roughness depth of 20.0 μm or less.

4. The steel sheet according to claim 2, comprising one or two or more selected from the following (1) to (4):

(1) wherein ferrite and bainite present in the surface soft layer have a total area fraction of 20% or more, and an area fraction of martensite present in the surface soft layer divided by a total area fraction of martensite and tempered martensite present in the surface soft layer is 0.45 or less, (2) comprising a metal coated layer as a first coated layer on one or both surfaces of the base steel sheet, (3) comprising a metal coated layer as a second coated layer on an outermost surface layer of one or both surfaces of the steel sheet, and (4) wherein a test specimen after 90-degree V-bending in which R/t obtained by dividing a critical bending radius R by a sheet thickness t is 4.5 or more and 5.0 or less has a surface roughness depth of 20.0 μm or less.

5. A member comprising the steel sheet according to claim 1.

6. A member comprising the steel sheet according to claim 2.

7. A member comprising the steel sheet according to claim 3.

8. A member comprising the steel sheet according to claim 4.

9. A method for producing a steel sheet, comprising:

a hot rolling step of hot-rolling a steel slab with the chemical composition according to claim 1;

an annealing step of annealing the resulting steel sheet in an atmosphere with an annealing temperature of an $Ac_1$ point or more and 950° C. or less, an annealing time of 10 seconds or more, and a dew-point temperature of −30° C. or more;

a first cooling step of cooling the steel sheet after the annealing step in a temperature range of the $Ac_1$ point to 450° C., in an atmosphere with a dew-point temperature of −30° C. or less, and at an average cooling rate of 8° C./s or more; and a second cooling step of cooling the steel sheet after the first cooling step at an average cooling rate of less than 8° C./s in a temperature range of less than 450° C. to 300° C.

10. A method for producing a steel sheet, comprising:

a hot rolling step of hot-rolling a steel slab with the chemical composition according to claim 2;

an annealing step of annealing the resulting steel sheet in an atmosphere with an annealing temperature of an $Ac_1$ point or more and 950° C. or less, an annealing time of 10 seconds or more, and a dew-point temperature of −30° C. or more;

a first cooling step of cooling the steel sheet after the annealing step in a temperature range of the $Ac_1$ point to 450° C., in an atmosphere with a dew-point temperature of −30° C. or less, and at an average cooling rate of 8° C./s or more; and a second cooling step of cooling the steel sheet after the first cooling step at an average cooling rate of less than 8° C./s in a temperature range of less than 450° C. to 300° C.

11. The method for producing a steel sheet according to claim 9, comprising one or two or more selected from the following (1) to (4):

(1) comprising a cold rolling step of cold-rolling the steel sheet after the hot rolling step and before the annealing step, (2) comprising a first coating step of performing metal coating on one or both surfaces of the steel sheet after the hot rolling step and before the annealing step to form a first coated layer, (3) comprising a second coating step of performing coating treatment on the steel sheet after the second cooling step to form a second coated layer, (4) comprising, after the second cooling step, a reheating and holding step of cooling the steel sheet to a cooling stop temperature in the range of 250° C. or less to room temperature, reheating the steel sheet to a reheating temperature range of (the cooling stop temperature+50° C.) to 450° C., and holding the steel sheet in the reheating temperature range for 10 seconds or more.

12. The method for producing a steel sheet according to claim 10, comprising one or two or more selected from the following (1) to (4):

(1) comprising a cold rolling step of cold-rolling the steel sheet after the hot rolling step and before the annealing step, (2) comprising a first coating step of performing metal coating on one or both surfaces of the steel sheet after the hot rolling step and before the annealing step to form a first coated layer, (3) comprising a second coating step of performing coating treatment on the steel sheet after the second cooling step to form a second coated layer, (4) comprising, after the second cooling step, a reheating and holding step of cooling the steel sheet to a cooling stop temperature in the range of 250° C. or less to room temperature, reheating the steel sheet to a reheating temperature range of (the cooling stop temperature+50° C.) to 450° C., and holding the steel sheet in the reheating temperature range for 10 seconds or more.

13. A method for producing a member, comprising a step of subjecting the steel sheet according to claim 1 to at least one of forming and joining to produce a member.

14. A method for producing a member, comprising a step of subjecting the steel sheet according to claim 2 to at least one of forming and joining to produce a member.

15. A method for producing a member, comprising a step of subjecting the steel sheet according to claim 3 to at least one of forming and joining to produce a member.

16. A method for producing a member, comprising a step of subjecting the steel sheet according to claim 4 to at least one of forming and joining to produce a member.

* * * * *